US010559178B2

(12) United States Patent
Perez et al.

(10) Patent No.: US 10,559,178 B2
(45) Date of Patent: Feb. 11, 2020

(54) PORTABLE POWER HANDHELD AND WEARABLE TAG DETACHERS

(71) Applicants: Sergio M. Perez, Lake Worth, FL (US); Adam S. Bergman, Boca Raton, FL (US)

(72) Inventors: Sergio M. Perez, Lake Worth, FL (US); Adam S. Bergman, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 0 days.

(21) Appl. No.: 15/872,590

(22) Filed: Jan. 16, 2018

(65) Prior Publication Data

US 2019/0221093 A1 Jul. 18, 2019

(51) Int. Cl.
*G08B 13/24* (2006.01)

(52) U.S. Cl.
CPC ..... *G08B 13/2434* (2013.01)

(58) Field of Classification Search
CPC ..... G06K 7/10396; G06K 7/10891; G06K 19/0723; H04W 12/08; E05B 73/0017; G08B 13/2434; G08B 13/242; G06F 1/163; G07G 1/0081
See application file for complete search history.

(56) References Cited

U.S. PATENT DOCUMENTS 4,521,678 A * 6/1985 Winter ..... G06K 7/10881 235/462.25
5,587,577 A * 12/1996 Schultz ..... B60R 11/02 235/462.44
6,405,049 B2 * 6/2002 Herrod ..... G06F 1/1626 455/517
9,514,342 B1 * 12/2016 Hosseini ..... G06F 1/163
2009/0160644 A1 * 6/2009 Yang ..... E05B 73/0017 340/571
2014/0249944 A1 * 9/2014 Hicks ..... G06K 7/10891 705/17
2015/0029028 A1 * 1/2015 Sayegh ..... G08B 13/242 340/572.3
2016/0316053 A1 * 10/2016 Dugoni ..... H04M 1/72577

* cited by examiner

*Primary Examiner* — Mirza F Alam
(74) *Attorney, Agent, or Firm* — Fox Rothschild LLP; Carol E. Thorstad-Forsyth; Robert J. Sacco

(57) ABSTRACT

Systems and methods for detaching a security tag from an article. The methods comprising: integrating a mobile communication device with a mobile tag detacher; receiving a tag body of the security tag in an insert space of the mobile tag detacher; mechanically coupling the tag body of the security tag to the mobile tag detacher if at least one of the mobile communication device and the mobile tag detacher verified that removal of the security tag from the article is permitted; performing operations by the mobile tag detacher to facilitate the detachment of the security tag from the article; and decoupling the tag body from the mobile tag reader such that the tag body is removable from the insert space.

28 Claims, 19 Drawing Sheets

Go To FIG. 17B

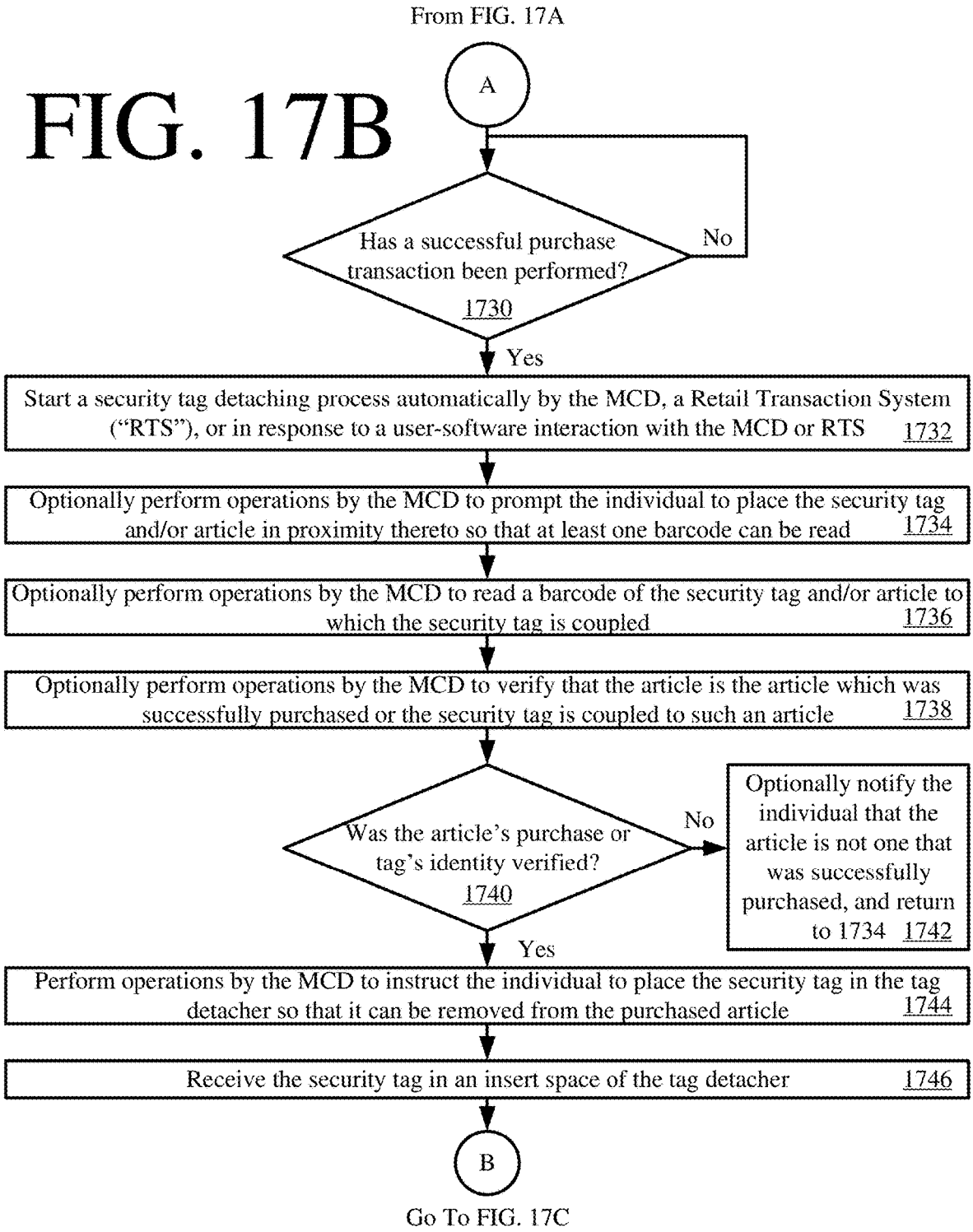
From FIG. 17A
A
FIG. 17B
Has a successful purchase transaction been performed? 1730
No
Yes
Start a security tag detaching process automatically by the MCD, a Retail Transaction System ("RTS"), or in response to a user-software interaction with the MCD or RTS 1732
Optionally perform operations by the MCD to prompt the individual to place the security tag and/or article in proximity thereto so that at least one barcode can be read 1734
Optionally perform operations by the MCD to read a barcode of the security tag and/or article to which the security tag is coupled 1736
Optionally perform operations by the MCD to verify that the article is the article which was successfully purchased or the security tag is coupled to such an article 1738
Was the article's purchase or tag's identity verified? 1740
No
Optionally notify the individual that the article is not one that was successfully purchased, and return to 1734 1742
Yes
Perform operations by the MCD to instruct the individual to place the security tag in the tag detacher so that it can be removed from the purchased article 1744
Receive the security tag in an insert space of the tag detacher 1746
B
Go To FIG. 17C

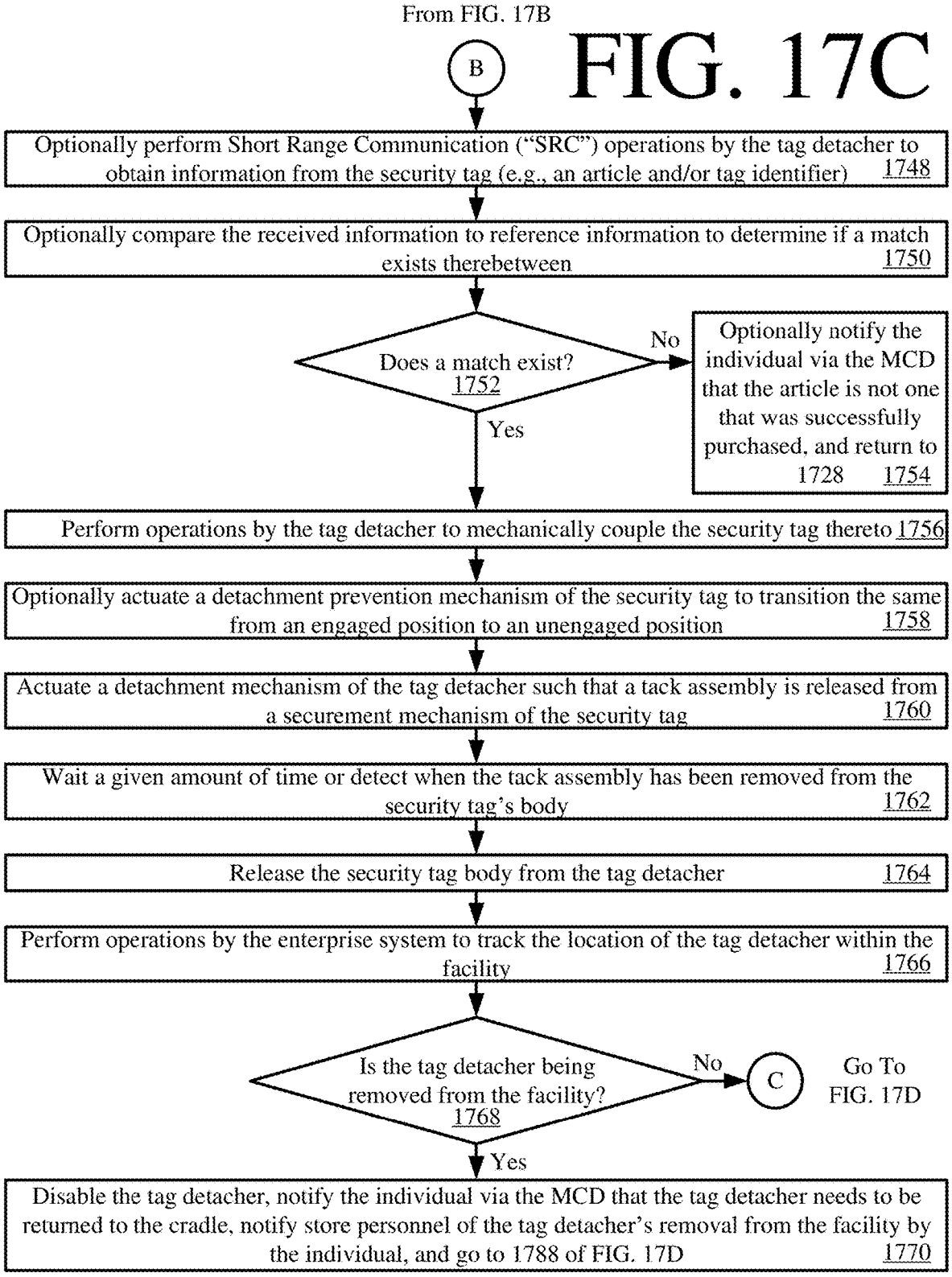
From FIG. 17B
B
FIG. 17C
Optionally perform Short Range Communication ("SRC") operations by the tag detacher to obtain information from the security tag (e.g., an article and/or tag identifier) 1748
Optionally compare the received information to reference information to determine if a match exists therebetween 1750
Does a match exist? 1752
No
Optionally notify the individual via the MCD that the article is not one that was successfully purchased, and return to 1728 1754
Yes
Perform operations by the tag detacher to mechanically couple the security tag thereto 1756
Optionally actuate a detachment prevention mechanism of the security tag to transition the same from an engaged position to an unengaged position 1758
Actuate a detachment mechanism of the tag detacher such that a tack assembly is released from a securement mechanism of the security tag 1760
Wait a given amount of time or detect when the tack assembly has been removed from the security tag's body 1762
Release the security tag body from the tag detacher 1764
Perform operations by the enterprise system to track the location of the tag detacher within the facility 1766
Is the tag detacher being removed from the facility? 1768
No
C
Go To FIG. 17D
Yes
Disable the tag detacher, notify the individual via the MCD that the tag detacher needs to be returned to the cradle, notify store personnel of the tag detacher's removal from the facility by the individual, and go to 1788 of FIG. 17D 1770

PORTABLE POWER HANDHELD AND WEARABLE TAG DETACHERS

BACKGROUND

Statement of the Technical Field

The present disclosure concerns generally to tag detaching systems. More particularly, the present invention relates to implementing systems and methods for providing portable power handheld and wearable tag detachers.

Description of the Related Art

A typical EAS system in a retail setting may comprise a monitoring system and at least one security tag or marker attached to an article to be protected from unauthorized removal. The monitoring system establishes a surveillance zone in which the presence of security tags and/or markers can be detected. The surveillance zone is usually established at an access point for the controlled area (e.g., adjacent to a retail store entrance and/or exit). If an article enters the surveillance zone with an active security tag and/or marker, then an alarm may be triggered to indicate possible unauthorized removal thereof from the controlled area. In contrast, if an article is authorized for removal from the controlled area, then the security tag and/or marker thereof can be detached therefrom. Consequently, the article can be carried through the surveillance zone without being detected by the monitoring system and/or without triggering the alarm.

Radio Frequency Identification ("RFID") systems may also be used in a retail setting for inventory management and related security applications. In an RFID system, a reader transmits a Radio Frequency ("RF") carrier signal to an RFID device. The RFID device responds to the carrier signal with a data signal encoded with information stored by the RFID device. Increasingly, passive RFID labels are used in combination with EAS labels in retail applications.

As is known in the art, security tags for security and/or inventory systems can be constructed in any number of configurations. The desired configuration of the security tag is often dictated by the nature of the article to be protected. For example, EAS and/or RFID labels may be enclosed in a rigid tag housing, which can be secured to the monitored object (e.g., a piece of clothing in a retail store). The rigid housing typically includes a removable pin which is inserted through the fabric and secured in place on the opposite side by a mechanism disposed within the rigid housing. The housing cannot be removed from the clothing without destroying the housing except by using a dedicated removal device.

A typical retail sales transaction occurs at a fixed Point Of Sale ("POS") station manned by a store sales associate. The store sales associate assists a customer with the checkout process by receiving payment for an item. If the item is associated with an EAS/RFID element, the store sales associate uses the dedicated removal device to remove the security tag from the purchased item.

A retail sales transaction can alternatively be performed using a mobile POS unit. Currently, there is no convenient way to detach a security tag using a mobile POS unit. Options include: the use of a fixed detacher unit located within the retail store which reduces the mobility of the mobile POS unit; or the use of a fixed detacher unit located at an exit of a retail store which burdens customers with a post-POS task. None of these options is satisfactory for large scale mobile POS adaption in a retail industry.

SUMMARY

The present invention concerns implementing systems and methods for detaching a security tag from an article. The methods comprise integrating a mobile communication device with a mobile tag detacher. This integration can be achieved by: establishing a communications connection between the mobile tag detacher and the mobile communication device; or mechanically and electrically coupling the mobile communication device to the mobile tag detacher. The mobile tag detacher may be worn by an individual.

Thereafter, a tag body of the security tag is received in an insert space of the mobile tag detacher. The tag body is mechanically coupled to the mobile tag detacher if at least one of the mobile communication device and the mobile tag detacher verified that removal of the security tag from the article is permitted. Barcode technology of the mobile communication device or wireless communication (e.g., RFID) technology of the mobile tag detacher can be used to make this verification.

The mobile tag detacher then performs operations to facilitate the detachment of the security tag from the article. The mobile tag detacher also performs operations to decouple the tag body from the mobile tag reader such that the tag body is removable from the insert space.

In some scenarios, the mobile tag detacher is released from a cradle prior to the integrating. The mobile tag detacher can be released from the cradle when a given code is received at the cradle or a user of the mobile communication device has been authenticated. The cradle may perform operations to cause the mobile tag detacher to become fully operational prior to releasing the mobile tag detacher from the cradle. Alternatively, the tag detacher performs operations to become fully operational when a detection is made thereby that it has been removed from the cradle.

Notably, an internal power source of the mobile tag detacher is charged through the cradle while the mobile tag detacher resides in a nest of the cradle. A power source of the mobile communication device may also be charged through the mobile tag detacher and/or cradle. Accordingly, the mobile tag detacher can have a dual purpose of (a) facilitating tag detachment from articles and (b) facilitating charging of mobile communication devices.

In those or other scenarios, the mobile communication device performs operations to facilitate a purchase transaction for the article. After completion of the purchase transaction, the mobile communication device outputs instructions for inserting the security tag in the mobile tag detacher. In response to these instructions, a security tag is inserted into the mobile tag detacher.

In those or other scenarios, the security tag's location within a facility is tracked. The mobile tag detacher is disabled if the security tag is or is being removed from the facility. Additionally or alternatively, personnel is notified of a determination that the mobile tag detacher is not located in a cradle or a given return location when no longer being utilized for tag detachment purposes by a given individual.

In those or other scenarios, at least one of the following amounts of time is determined: a first amount of time since the mobile tag detacher was removed from a cradle; and a second amount of time since a last security tag detachment.

The mobile tag detacher is disabled if the first and/or second amount of time is equal to or greater than a threshold value.

BRIEF DESCRIPTION OF THE DRAWINGS

Embodiments will be described with reference to the following drawing figures, in which like numerals represent like items throughout the figures.

FIGS. 17A-17D (collectively referred to herein as "FIG. 17") is a flow diagram of an illustrative method for detaching a security tag from an article.

DETAILED DESCRIPTION

Figure 1:
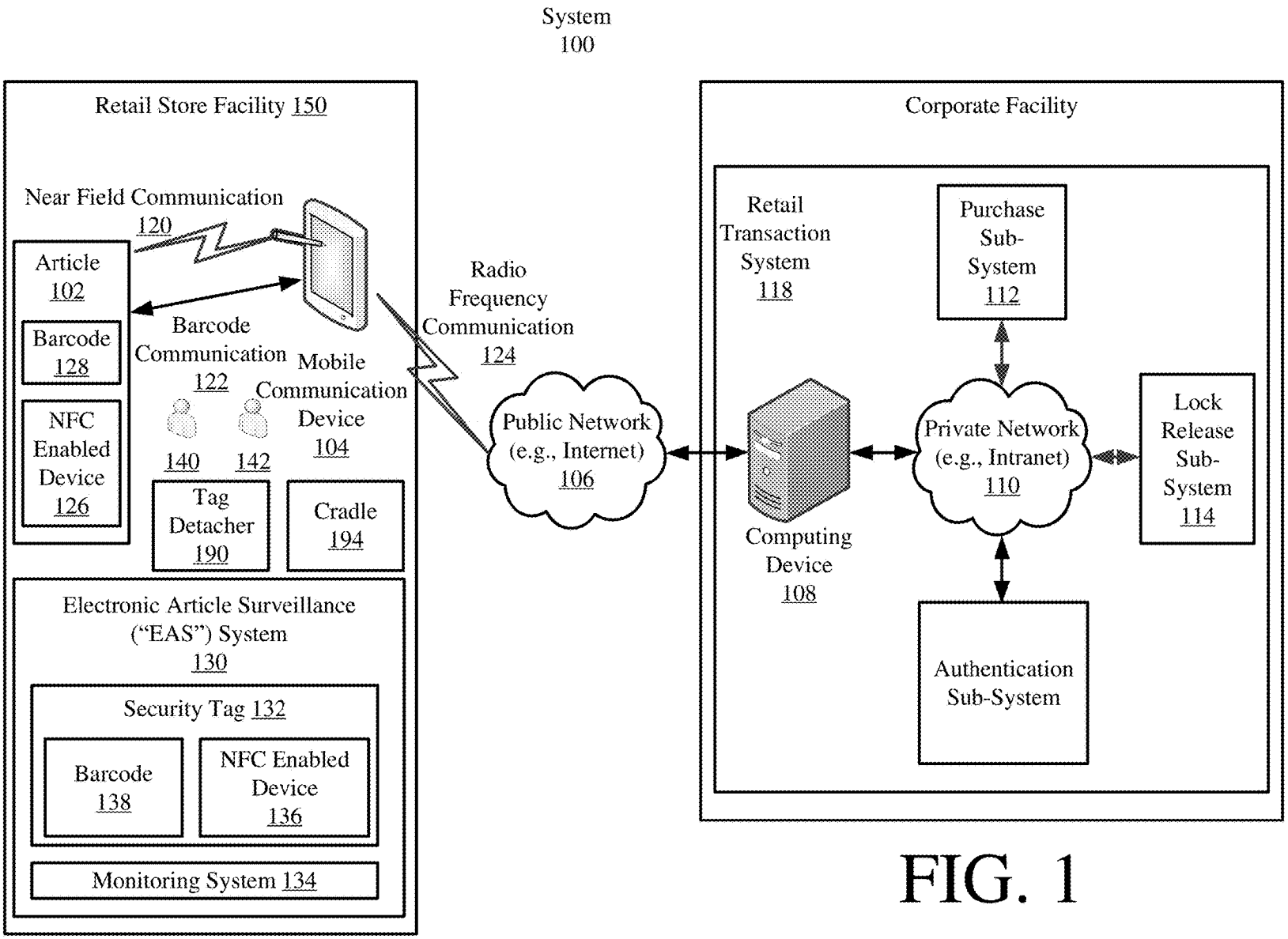
FIG. 1 is an illustration of an illustrative system.
Figure 2:
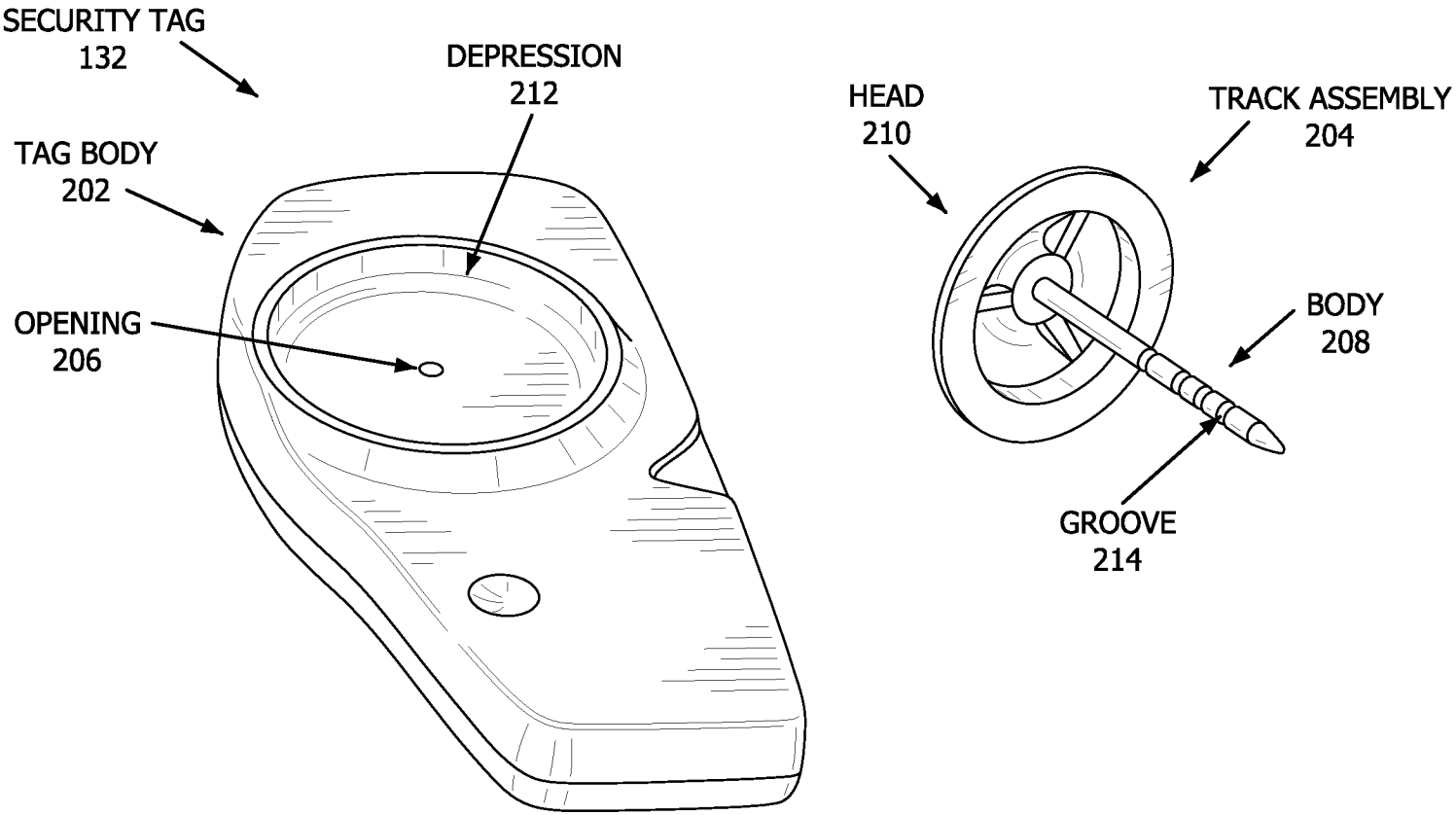
FIG. 2 is an illustration of the security tag with a tack assembly removed therefrom.
Figure 3:
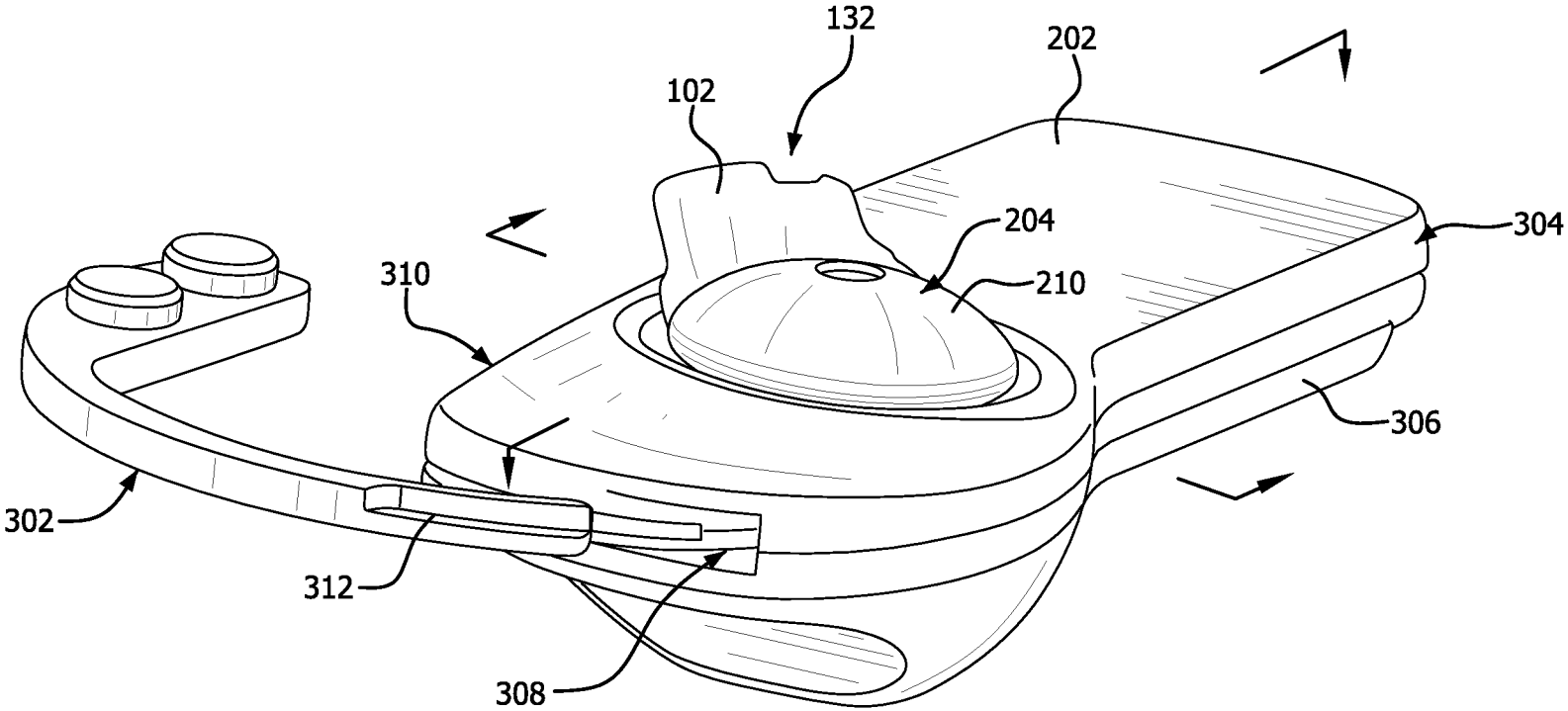
FIG. 3 is an illustration of the security tag with the tack assembly coupled thereto.
Figure 4:
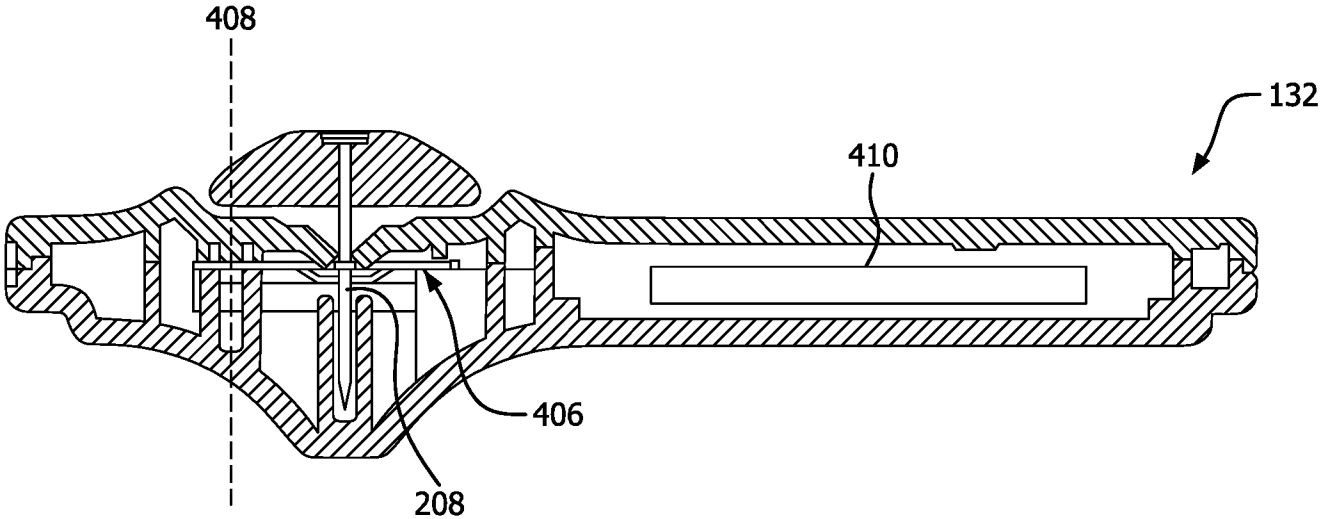
FIG. 4 is a cross sectional view of the security tag with the tack assembly coupled thereto.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present solution concerns portable power handheld and wearable tag detachers. The detachers are sized and shaped to fit into a cradle of a table-top charging station. The detachers lock into the charging station, and can serve as a table-top power detaching unit while in their locked positions. The detachers also comprise mechanical and electrical interfaces with mobile POSs (e.g., smart phones).

Illustrative Systems for Detachment of Tags

Referring now to FIG. 1, there is provided a schematic illustration of an illustrative system 100. System 100 is generally configured to allow an individual to purchase an article 102 using a Mobile Communication Device ("MCD") 104 and to have a security tag 132 detached from the article 102 using a tag detacher 190. Security tags are well known in the art, and therefore will not be described here in detail. Any known or to be known security tag can be used herein without limitation. For example, the security tag 132 comprises a tag having part number ZL303-G-100 and which is available from Tyco Retail Solutions (part of Johnson Controls) of Boca Raton, Fla. The tag is designed to be used with a tack that is inserted through an article and into the security tag. The tag has a part number MJAMT3200-G and is also available from Tyco Retail Solutions. The present solution is not limited to the particulars of this example.

The tag detacher 190 is a portable device and/or a wearable device. Accordingly, the tag detacher 190 can be carried or worn by an individual 140, 142. In the later scenario, the tag detacher 190 is provided with a wrist band, a strap, a chain, a belt clip or other coupling means for coupling the tag detacher to an individual.

The tag detacher 190 is also designed to be mechanically and/or electrically coupled the MCD 104. In some scenarios, the tag detacher 190 wraps around at least a portion of MCD 104. Communications between the MCD 104 and tag detacher 190 are achieved using wired communications and/or wireless communications. The wireless communications include, but are not limited to, Short Rage Communications ("SRCs"). The SRCs can be achieved using Bluetooth technology.

The tag detacher 190 also employs other wireless SRC technologies to facilitate the purchase of the article 102 and/or the detachment of the security tag 132 from the article 102. The other wireless SRC technologies can include, but are not limited to, Near Field Communication ("NFC") technology, InfRared ("IR") technology, Wireless Fidelity ("Wi-Fi") technology, Radio Frequency Identification ("RFID") technology, and/or ZigBee technology. The tag detacher 190 may also employ barcode technology, electronic card reader technology, and Wireless Sensor Network ("WSN") communications technology.

The tag detacher 190 comprises a rechargeable power source (e.g., battery and/or capacitor). In this regard, a cradle 194 is provided to receive the tag detacher 190 in a nest. The tag detacher's rechargeable power source is charged via the cradle 194. The MCD may also be charged via the tag detacher 190 and cradle 194.

A coupling mechanism is provided to selectively couple the tag detacher 190 to the cradle 194. The tag detacher 190 is decoupled from the cradle 194 when authentication of an individual (authorized to use the tag detacher) is made by the cradle 194, the tag detacher 190 and/or the MCD 104. The authentication can be achieved using RFID technology, card access technology, biometric technology (e.g., fingerprint scanning technology) and/or other authentication technology.

As shown in FIG. 1, system 100 comprises a Retail Store Facility ("RSF") 150 including an EAS system 130. The EAS system 130 comprises a monitoring system 134 and at least one security tag 132. Although not shown in FIG. 1, the security tag 132 is attached to article 102, thereby protecting the article 102 from an unauthorized removal from the retail store facility 150. The monitoring system 134 establishes a surveillance zone (not shown) within which the presence of the security tag 132 can be detected. The surveillance zone is established at an access point (not shown) for the retail store facility 150. If the security tag 132 is carried into the surveillance zone, then an alarm is triggered to indicate a possible unauthorized removal of article 102 from the retail store facility 150.

During store hours, an individual 140 may desire to purchase the article 102. The individual 140 can purchase the article 102 without using a traditional fixed POS station (e.g., a checkout counter). Instead, the purchase transaction can be achieved using MCD 104. MCD 104 (e.g., a mobile phone or tablet computer) can be in the possession of the individual 140 or store associate 142 at the time of the purchase transaction. Notably, MCD 104 has a retail transaction application installed thereon that is configured to facilitate the purchase of article 102 and the management/control of the tag detacher operations for an attachment/detachment of the security tag 132 to/from article 102. The retail transaction application can be a pre-installed application, an add-on application or a plug-in application. Retail transaction applications are well known in the art, and therefore will not be described in detail herein. Any known or to be known retail transaction application can be used herein without limitation.

In order to initiate a purchase transaction, the retail transaction application is launched via a user-software interaction. The retail transaction application facilitates the exchange of data between the article 102, security tag 132, individual 140, store associate 142, and/or Retail Transaction System ("RTS") 118. For example, after the retail transaction application is launched, a user 140, 142 is prompted to start a retail transaction process for purchasing the article 102. The retail transaction process can be started simply by performing a user software interaction, such as depressing a key on a keypad of the MCD 104 or touching a button on a touch screen display of the MCD 104.

Subsequently, the user 140, 142 may manually input into the retail transaction application article information. Alternatively or additionally, the user 140, 142 places the MCD 104 in proximity of article 102. As a result of this placement, the MCD 104 and/or tag detacher 190 obtains article information from the article 102. The article information includes any information that is useful for purchasing the article 102, such as an article identifier and an article purchase price. In some scenarios, the article information may even include an identifier of the security tag 132 attached thereto. The article information can be communicated from the article 102 to the MCD 104 and/or tag detacher 190 via a short range communication, such as a barcode communication 122 or an NFC 120. In the barcode scenario, article 102 has a barcode 128 attached to an exposed surface thereof. In the NFC scenarios, article 102 may comprise an NFC enabled device 126. If the tag detacher 190 obtains the article information, then it forwards it to MCD 104 via a wireless SRC, such as a Bluetooth communication.

Thereafter, payment information is input into the retail transaction application of MCD 104 by the user 140, 142. Upon obtaining the payment information, the MCD 104 automatically performs operations for establishing a retail transaction session with the RTS 118. The retail transaction session can involve: communicating the article information and payment information from MCD 104 to the RTS 118 via an RF communication 124 and public network 106 (e.g., the Internet); completing a purchase transaction by the RTS 118; and communicating a response message from the RTS 118 to MCD 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Google Wallet®).

The purchase transaction can be completed by the RTS 118 using the article information and payment information. In this regard, such information may be received by a computing device 108 of the RTS 118 and forwarded thereby to a sub-system of a private network 100 (e.g., an Intranet). For example, the article information and purchase information can also be forwarded to and processed by a purchase sub-system 112 to complete a purchase transaction. When the purchase transaction is completed, a message is generated and sent to the MCD 104 indicating whether the article 102 has been successfully or unsuccessfully purchased.

If the article 102 has been successfully purchased, then a security tag detaching process can be started automatically by the RTS 118 or by the MCD 104. Alternatively, the user 140, 142 can start the security tag detaching process by performing a user-software interaction using the MCD 104. In all three scenarios, the article information can optionally be forwarded to and processed by a lock release sub-system 114 to retrieve a detachment key or a detachment code that is useful for detaching the security tag 132 from the article 102. The detachment key or code is then sent from the RTS 118 to the MCD 104 such that the MCD 104 can perform or cause the tag detacher 190 to perform tag detachment operations. The tag detachment operations are generally configured to cause the security tag 132 to actuate a detaching mechanism (not shown in FIG. 1). In this regard, the MCD or tag detacher generates a detach command and sends a detach signal including the detach command to the tag detacher 190. The tag detacher 190 authenticates the detach command and activates the detaching mechanism. For example, the detach command causes: (a) a detachment mechanism to enter an insert space formed in the housing of the security tag 132, travel through an arcuate channel towards a securement mechanism, engage the securement mechanism, and apply a pushing force on the securement mechanism; (b) a magnetic field to be applied to a magnetic coupler (e.g., clamp) for releasing a tack assembly; or (c) a retractable pin to be retracted such that the security tag can be removed from the article 102. Once the security tag 132 has been removed from article 102, the customer 140 can carry the article 102 through the surveillance zone without setting off the alarm.

Referring now to FIGS. 2-7, there is provided schematic illustrations useful for understanding operations of the security tag 132. Security tag 132 is described below as a security tag with a clamping securement mechanism that is actuated using a tool inserted into the security tag's housing. The present solution is not limited to such security tag configurations. The present solution can be used with any other type of security tag architecture.

As shown in FIGS. 2-7, the security tag 132 includes a tag body 202 formed of a housing 310 with an upper housing member 304 joined to a lower housing member 306. The housing members 304, 306 can be joined together via an adhesive, a mechanical coupling means (e.g., snaps, screws, etc.), or a weld (e.g., an ultrasonic weld). The housing 310 can be made from a rigid or semi-rigid material, such as plastic. The housing 310 has an opening 206 formed therein such that at least a portion of a tack assembly 204 (or attachment element) can be inserted into the security tag for facilitating the attachment of the security tag to an article 102 (e.g., a piece of clothing). EAS and/or RFID components 410 is(are) contained within the housing 310. EAS and RFID components of security tags are well known in the art, and therefore will not be described herein. Any known or to be known EAS and/or RFID component can be used herein without limitation.

Tack assembly 204 has a tack head 210 and an elongate tack body 208 extending down and away from the tack head. The tack body 208 is sized and shaped for insertion into opening 206 and removal from opening 206. A plurality of grooves 214 is formed along a length of the tack body 208 for engagement with a securement mechanism 406 disposed within the housing 310. When the grooves are engaged by the securement mechanism 406, the security tag 132 is secured to the article 102. Thereafter, unauthorized removal of the article 102 from a controlled area (e.g., RSF 150 of FIG. 1) can be detected by a monitoring device of the EAS system 130. Such monitoring devices are well known in the art, and therefore will not be described herein. Still, it should be understood that at least one sensor (not shown in FIGS. 1-5) is disposed within the housing 310. The sensor includes, but is not limited to, an acoustically resonant magnetic sensor. In all cases, the sensor generates signals which can be detected by the monitoring device.

Such detection occurs when the security tag 132 is present within a surveillance zone (or interrogation zone) established by the monitoring system 134. The surveillance zone (or interrogation zone) is usually established at an access point for the controlled area (e.g., adjacent to a retail store entrance and/or exit). If the article 102 enters the surveillance zone (or interrogation zone) with the security tag 132, then an alarm may be triggered to indicate possible unauthorized removal thereof from the controlled area. In contrast, if the article 102 is authorized for removal from the controlled area, then the security tag 132 thereof can be deactivated and/or detached therefrom using a detachment mechanism 302 (or external tool) of the tag detacher 190. Consequently, the article 102 can be carried through the surveillance zone (or interrogation zone) without being detected by the monitoring system 134 and/or without triggering the alarm.

The detachment mechanism 302 is sized and shaped to at least be partially slidingly inserted into and removed from an insert space 308 formed in the housing 310. When inserted into insert space 308, the detachment mechanism 302 travels through an arcuate channel 502 so as to be guided towards the securement mechanism 406. In this regard, the detachment mechanism 302 has a generally arcuate shape matching that of the arcuate channel 502. Upon engagement with the securement mechanism 406, the detachment mechanism 302 releases the tack body 208 therefrom. Next, the tack body 208 can be removed from the housing, so as to decouple the security tag 132 from the article 102.

Figure 5:
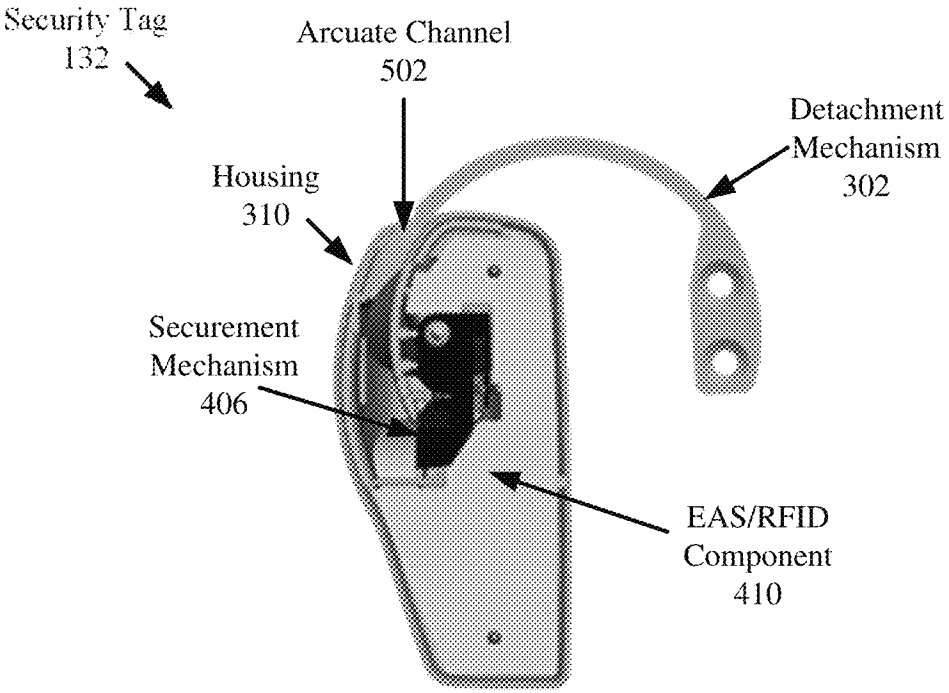
FIGS. 5-6 provide illustrations that are useful for understanding how the tack assembly can be released using a detachment mechanism.
Figure 6:
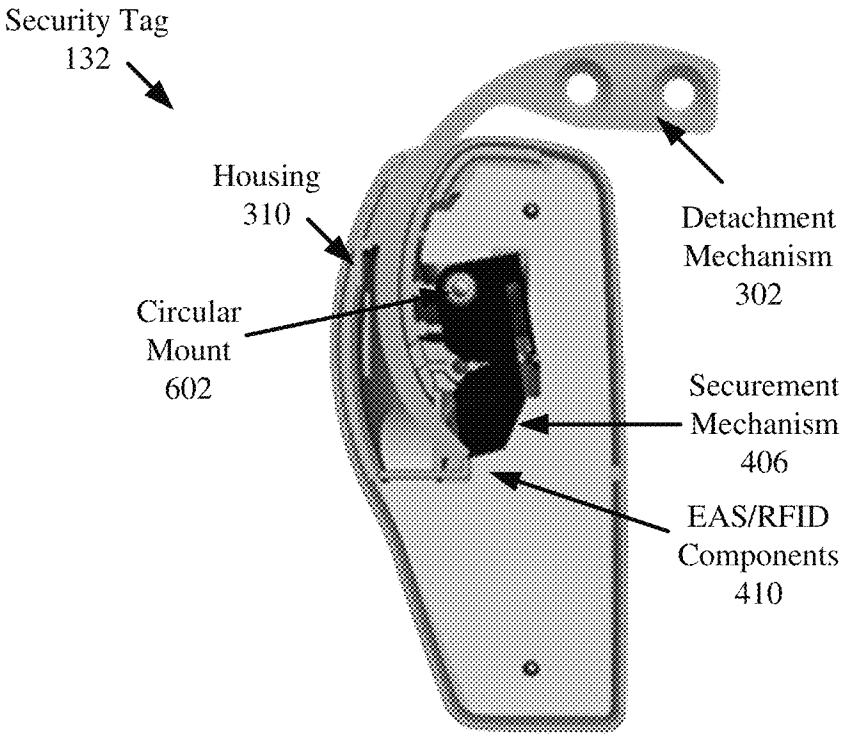
Figure 7:
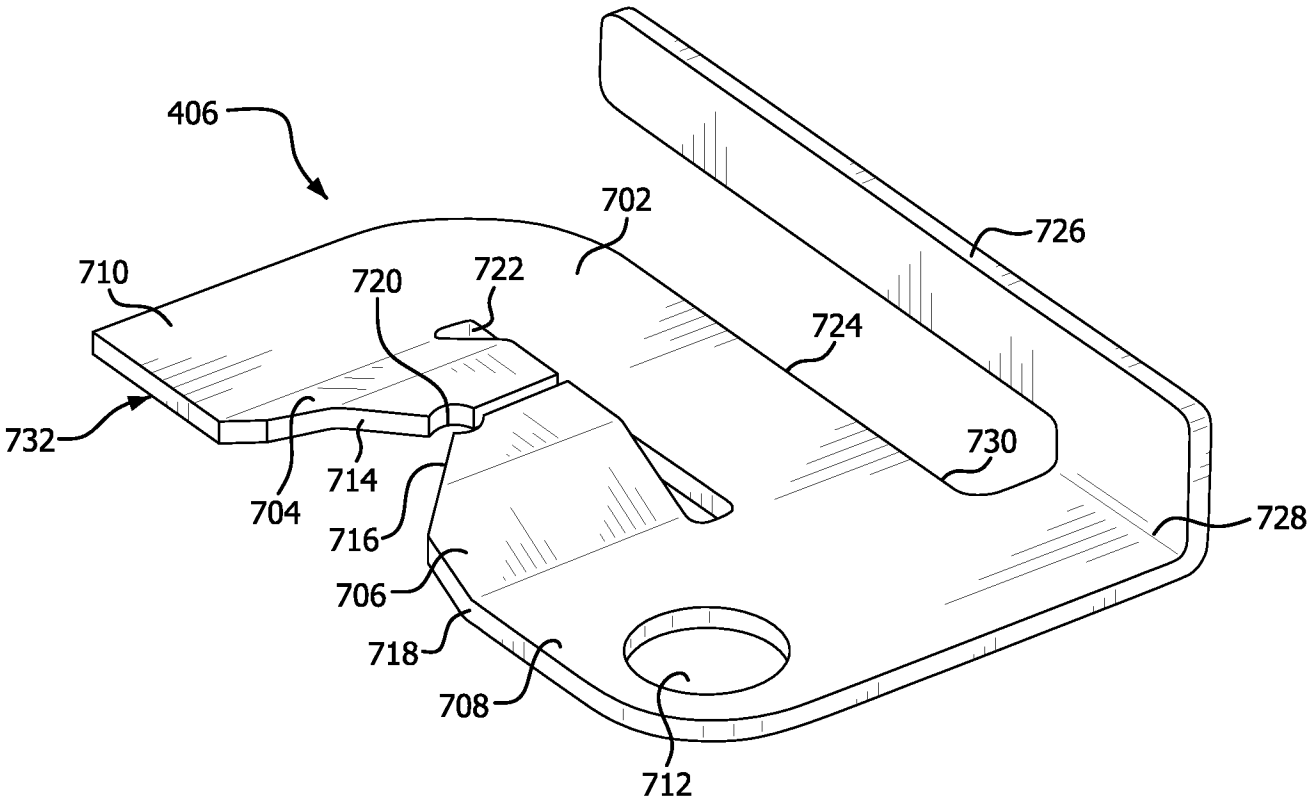
FIG. 7 is an illustration of a securement mechanism.

A schematic illustration of the securement mechanism 406 is provided in FIG. 7. As noted above, the securement mechanism 406 is specifically adapted to accommodate release of the tack body 208 via the detachment mechanism 302 (or arcuate probe) moving in the arcuate channel 502. The securement mechanism 406 is generally in the form of a spring clamp securely disposed within the housing 310 of the security tag so as to be pivotable (or rotatable) about an axis 408. In this regard, the spring clamp comprises a clamp body 702 and jaws 704, 706. The clamp body 702 includes a mounting part 708 extending laterally of jaw 706 and a release part 710 extending laterally of jaw 704. The mounting part 708 includes a mounting aperture 712 facilitating the pivotable movement of the securement mechanism 406 within the housing of the security tag. The pivotable movement allows the securement mechanism 406 to be transitioned by the detachment mechanism 302 (or arcuate probe) from a first position in which the tack assembly is locked thereto (as shown in FIG. 5) and a second position in which the tack assembly is released or unlocked therefrom (as shown in FIG. 6).

Each of the jaws 704, 706 extends outwardly of the plane of the clamp body 702 and then inwardly toward the other jaw. The jaws 704, 706 terminate in facing edges 714, 716. These edges extend from a common edge 718 of the clamp body 702 inwardly toward each other, then curve outwardly away from each other to define an aperture 720 (typically, circular or elliptical) for receiving the tack body 208. The edges 714, 716 then continue in aligned fashion and end in an elongated, lateral slot 722 in the clamp body 702. The lateral slot lies inward of a further clamp body edge 724 which opposes the clamp body edge 718.

A further laterally extending elongated spring sleeve 726 is attached by a joint area 728 to the side 730 of the edge 724 bordering the mounting part 708. The sleeve 726 extends along the length of the edge 724 and is also out of the plane of the clamp body 702.

For mounting and supporting the spring clamp 702, the lower housing member 306 of the security tag 132 includes a circular mount 602. The spring clamp 406 is mounted, via aperture 712 of the mounting part 708, on the circular mount 602. In this way, the mounting part 708 can be rotated about the circular mount 602. The spring clamp 702 is thus able to pivot about the mounting part 708.

When an end of the tack assembly 204 is introduced in the downward direction through the opening 206 in the upper housing member 304, the tack body 208 is directed to aperture 720 of the securement mechanism 706. This causes the jaws 704, 706 to spread open and allow the tack body 208 to pass there through.

When the downward movement of the tack assembly 204 is stopped, the jaws 704, 706 retract and clutch the tack body 208. In this position, the jaws 704, 706 prevent upward movement of the tack assembly 204. As such, the security tag 132 becomes securely coupled to the article 102.

In order to release the tack body 208 from the jaws 704-706, the detachment mechanism 302 is introduced into the insert space 308 formed in the housing 310 of the security tag 132. Rotation of the detachment mechanism 302 causes it to be moved in and guided by the arcuate channel 502 until the end 312 abuts portion 732 of the securement mechanism 406. Continued rotational movement of the detachment mechanism 302 causes force to be applied to portion 732 of the securement mechanism 406. This force, in turn, causes the clamp body 702 to rotate about the support area 708. The jaw 704 is thus enabled to spread away from jaw 706 due to the force of the tack body 208, which is being held stationary by jaw 706. As a result, aperture 720 expands, releasing the tack body 208 from the clutch of the jaws. The tack assembly 204 can now be moved in the upward direction past the jaws, via an upward force on the tack head 210.

During rotation of the clamp body 702, the spring sleeve 726 at the joint area 728 is compressed. After the tack assembly 204 is separated from the housing 310, the detachment mechanism 302 is rotated in the reverse direction. This reverse rotation disengages the detachment mechanism 302 from the securement mechanism 406. Consequently, the spring sleeve 726 rotates in an opposite direction so as to be brought back to its original position. Thereafter, the detachment mechanism 302 is guided out of the arcuate channel 502 and is removed from insert space 312 formed in the housing 310.

As evident from the above discussion, the detachment mechanism 302 is provided to deflect the securement mechanism 406 so as to allow the tack assembly 204 to be removed from the housing 310. The detachment mechanism 302 is part of the external tag detacher 190. When the tack assembly 204 is removed from the housing 310, the security tag 132 can be decoupled from an article 102 (e.g., a piece of clothing).

Figure 8:
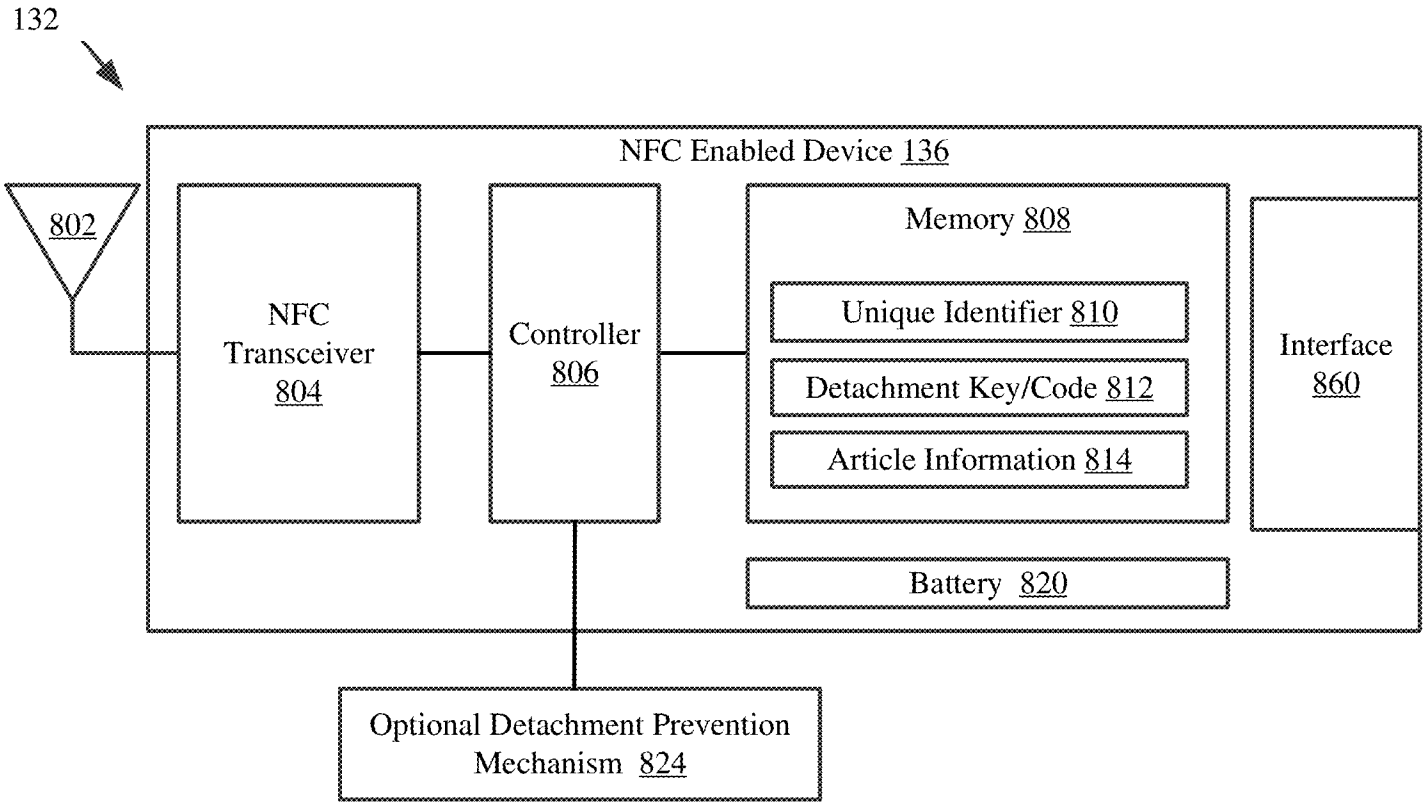
FIG. 8 is an illustration of the security tag's internal components.

Referring now to FIG. 8, there is provided an illustration of the NFC enabled device 136 disposed in the security tag's housing 310. Security tag 132 can include more or less components than that shown in FIG. 8. However, the components shown are sufficient to disclose an illustrative embodiment implementing the present solution. Some or all of the components of the security tag 132 can be implemented in hardware, software and/or a combination of hardware and software. The hardware includes, but is not limited to, one or more electronic circuits. The electronic circuit(s) may comprise passive components (e.g., capacitors and resistors) and active components (e.g., processors) arranged and/or programmed to implement the methods disclosed herein.

The hardware architecture of FIG. 8 represents an exemplary representative security tag 132 configured to facilitate the prevention of an unauthorized removal of an article (e.g., article 102 of FIG. 1) from an RSF (e.g., RSF 150 of FIG. 1). In this regard, the security tag 132 comprises an antenna 802 and an NFC enabled device 136 for allowing data to be exchanged with the external device via NFC technology. The antenna 802 is configured to receive NFC signals from the external device and transmit NFC signals generated by the NFC enabled device 136. The NFC enabled device 136 comprises an NFC transceiver 804. NFC transceivers are well known in the art, and therefore will not be described herein. However, it should be understood that the NFC transceiver 804 processes received NFC signals to extract information therein. This information can include, but is not limited to, a request for certain information (e.g., a unique identifier 810), and/or a message including information specifying a detachment key or code 812 for detaching the security tag 132 from an article. The NFC transceiver 804 may pass the extracted information to the controller 806.

If the extracted information includes a request for certain information, then the controller 806 may perform operations to retrieve a unique identifier 810 and/or article information 814 from memory 808. The article information 814 can include a unique identifier of an article and/or a purchase price of the article. The retrieved information is then sent from the security tag 132 to a requesting external device (e.g., MCD 104 of FIG. 1) via an NFC communication.

In contrast, if the extracted information includes information specifying a one-time-only use key and/or instructions for programming the security tag 132 to actuate an optional detachment prevention mechanism 824, then the controller 806 may perform operations to simply actuate the detachment prevention mechanism 824 using the one-time-only key. The detachment prevention mechanism 824 may comprise a movable structure that can (a) selectively prevent the detachment mechanism's 302 access to the securement mechanism 406 and/or (b) selectively prevent rotation of the securement mechanism 406 by the detachment mechanism 302. Illustrative detachment prevention mechanisms are described in U.S. Pat. No. 9,218,730 to Nguyen and U.S. Patent Publication No. 2015/0061872 to Chandramowle. When actuated, the detachment prevention mechanism 824 moves from an engaged position (in which it extends into the arcuate channel and/or engages the securement mechanism to prevent rotation thereby) to an unengaged position (in which it no longer extends into the channel and/or engages the securement mechanism such that the securement mechanism can be rotated about circular mount 602 when a pushing force is applied thereto by the detachment mechanism 302).

Alternatively or additionally, the controller 806 can: parse the information from a received message; retrieve a detachment key/code 812 from memory 808; and compare the parsed information to the detachment key/code to determine if a match exists therebetween. If a match exists, then the controller 806 generates and sends a command to the detachment prevention mechanism 824. An auditory or visual indication can be output by the security tag 132 when the detachment prevention mechanism 824 is actuated. If a match does not exist, then the controller 806 may generate a response message indicating that detachment key/code specified in the extracted information does not match the detachment key/code 812 stored in memory 808. The response message may then be sent from the security tag 132 to a requesting external device (e.g., MCD 104 of FIG. 1) via a wireless short-range communication or a wired communication via interface 860. A message may also be communicated to another external device or network node via interface 860.

In some scenarios, the connections between components 804, 806, 808, 860, 824 are unsecure connections or secure connections. The phrase "unsecure connection", as used herein, refers to a connection in which cryptography and/or tamper-proof measures are not employed. The phrase "secure connection", as used herein, refers to a connection in which cryptography and/or tamper-proof measures are employed. Such tamper-proof measures include enclosing the physical electrical link between two components in a tamper-proof enclosure.

Notably, the memory 208 may be a volatile memory and/or a non-volatile memory. For example, the memory 208 can include, but is not limited to, a Random Access Memory ("RAM"), a Dynamic Random Access Memory ("DRAM"), a Static Random Access Memory ("SRAM"), a Read-Only Memory ("ROM") and a flash memory. The memory 208 may also comprise unsecure memory and/or secure memory. The phrase "unsecure memory", as used herein, refers to memory configured to store data in a plain text form. The phrase "secure memory", as used herein, refers to memory configured to store data in an encrypted form and/or memory having or being disposed in a secure or tamper-proof enclosure.

The present solution is not limited to the security tag architecture described above in which a removable tack assembly is employed to secure the security tag 132 to the article 102. For example, the article 102 can alternatively or additionally be securely coupled or attached to the security tag 132 via a retractable pin, a lanyard, a plunger, a plastic strap, a clamp, or a clasp.

Also, the securement mechanism 406 can alternatively comprise a magnetic clamp or clasp. Such securement mechanisms are well known in the art, and will not be described in detail herein. A security tag with an exemplary tack/magnetic clamp arrangement is described in U.S. Pat. No. 8,847,762 to Ming-Ren et al. In some scenarios, the security tag is the same as or similar to that described in this patent.

Figure 9:
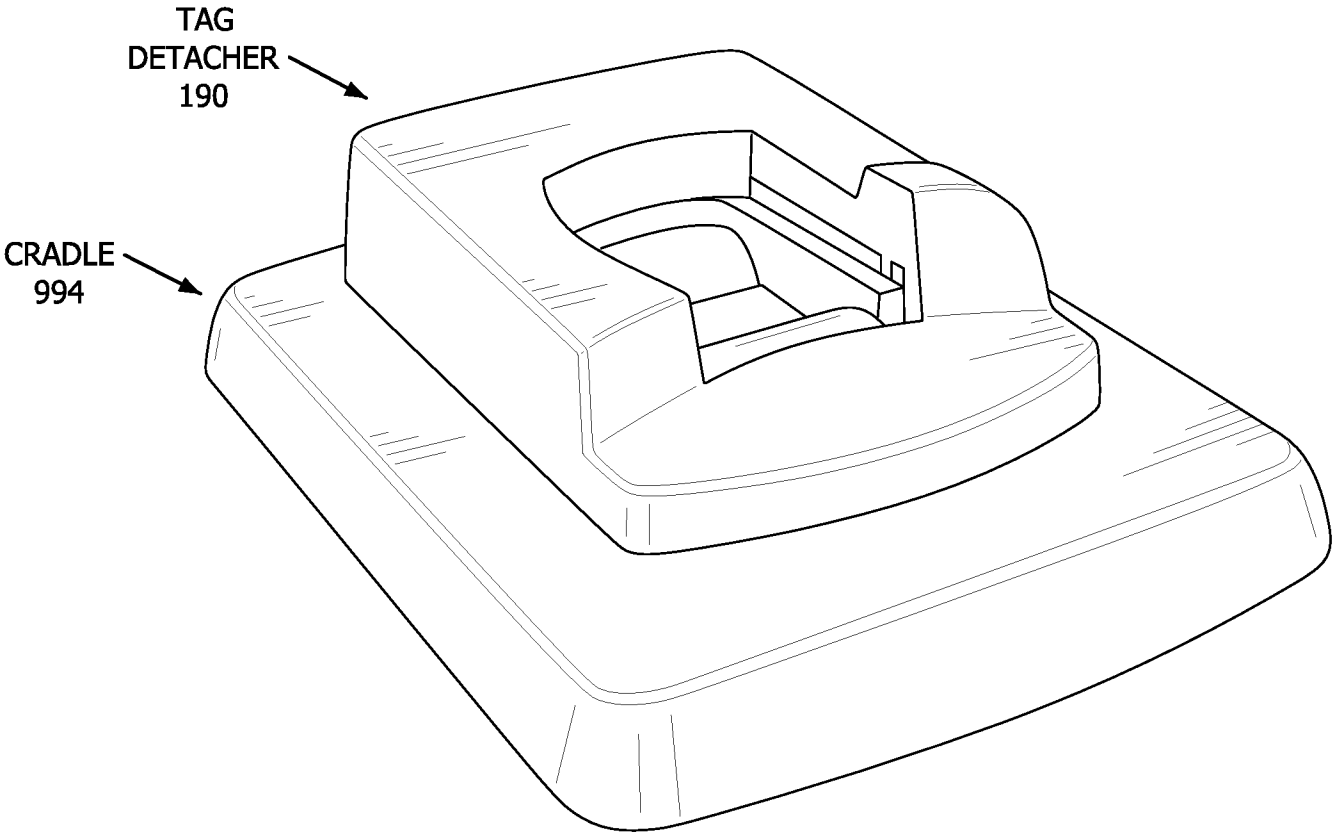
FIG. 9 is an illustration of a tag detacher disposed in a cradle.
Figure 10:
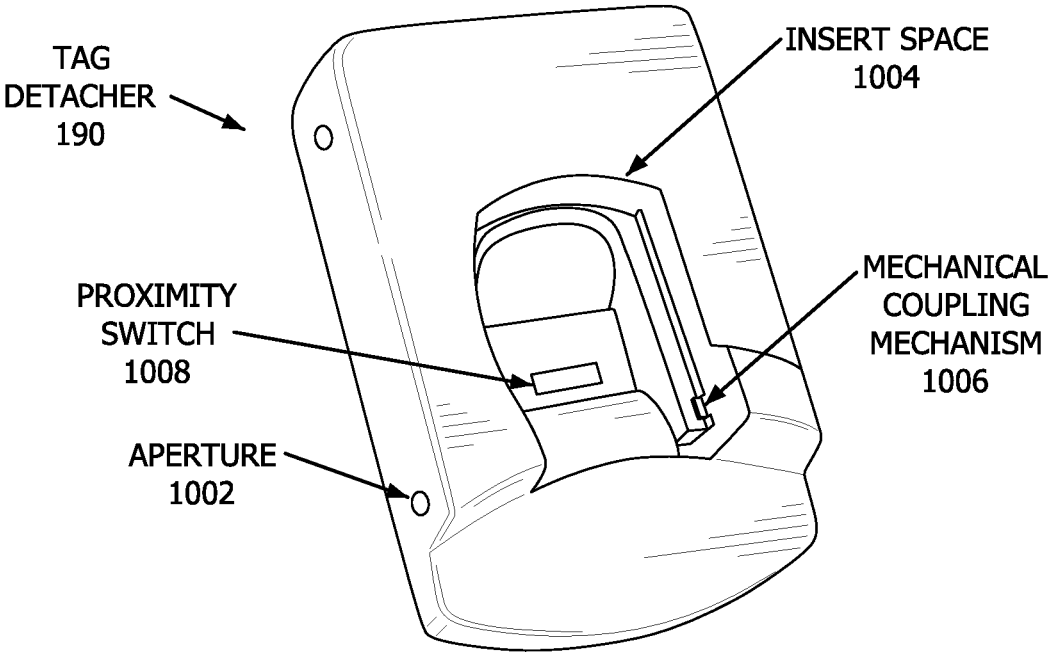
FIG. 10 is a front perspective view of the tag detacher shown in FIG. 9.
Figure 11:
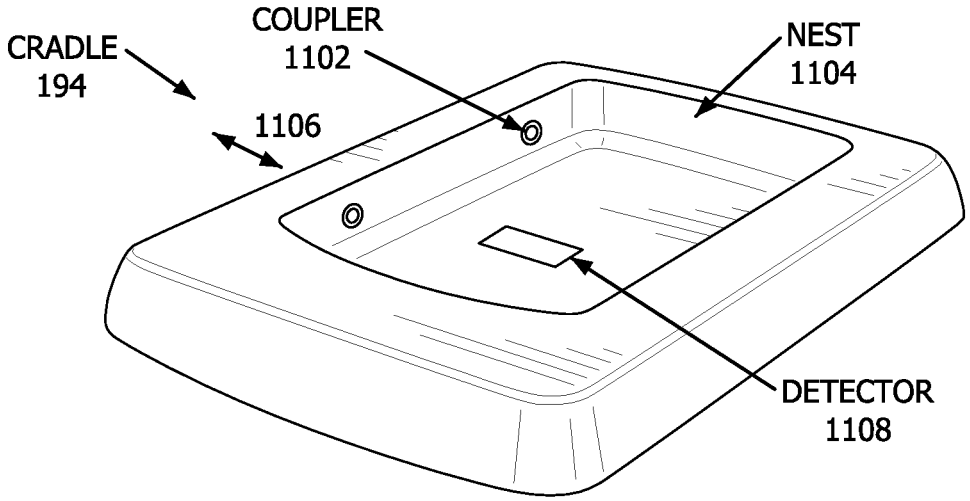
FIG. 11 is a front perspective view of the cradle shown in FIG. 9.

Referring now to FIGS. 9-11, there are provided illustrations that are useful for understanding the tag detacher 190 and cradle 194 of FIG. 1. The cradle 194 is configured to charge a rechargeable power source of the tag detacher 190 while the tag detacher is disposed in a nest 1104 thereof (shown in FIG. 9). In this regard, the tag detacher 190 and cradle 194 comprise mating electrical connectors and/or contact pads (not shown in FIGS. 9-11, but shown in FIG. 15 in relation to reference number 1532). The cradle 194 also comprises an electrical connection to an AC mains (not shown in FIGS. 9-11, but shown in FIG. 15 in relation to reference number 1534).

In first scenarios, the tag detacher 190 is able to detach tags from articles at all times when disposed in the cradle 194. In second other scenarios, the tag detacher 190 is unable to detach tags from articles when disposed in the cradle 194 until an enablement code is received by the cradle 194 or tag detacher 190. The enablement code can be provided by an individual (e.g., a customer 140 or a store associate 142) via a user interface of the cradle 194 or MCD 104. In yet third other scenarios, the tag detacher 190 is unable to detach tags from articles at all times when disposed in the cradle 194. In this regard, the cradle 194 can be configured in at least the second and third other scenarios to selectively communicate enablement commands and/or disablement commands to the tag detacher 190 when disposed in the nest 1104. Alternatively or additionally, the tag detacher 190 is configured in at least the second and third other scenarios to (a) detect when it is inserted in and removed from the cradle 194, and (b) enable/disable tag detaching operations based on the detections.

The tag detacher 190 is lockingly secured to the cradle 194 when placed in the nest 1104 (shown in FIG. 9). The locking securement is achieved by moving couplers 1102 of the cradle 194 into apertures 1002 of the tag detacher 190. The couplers 1102 can include, but are not limited to, posts which are movable in two opposing directions 1106 (i.e., in and out of the cradle 194). Techniques for moving posts in two opposing directions are well known in the art. Any known or to be known technique for moving the posts in two opposing direction can be used herein without limitation. For example, a motor, a gear, and/or a solenoid is(are) used to facilitate the post's movement in and out of the cradle 194.

The cradle 194 includes an internal circuit that causes actuation of the couplers 1102 for unlocking the tag detacher 190 therefrom (a) when the user's identity has been authenticated by the cradle 194, the MCD 104 of FIG. 1 and/or an enterprise system (e.g., computing device 108 of FIG. 1), and/or (b) when a proper code is provided to the cradle 194. The user authentication can be achieved using RFID technology, access card technology, and/or biometric scanning technology (e.g., fingerprint scanning). In some scenarios, a store associate 142 enters the code directly into the cradle 194 or indirectly into the cradle 194 via MCD 104 and/or tag detacher 190. Upon receipt of the code, the cradle 194 performs operations to compare the entered code to at least one reference code stored in a memory of the cradle 194. (e.g., memory 1512 of FIG. 15). If a match exists, then the tag detacher 190 is released from the cradle 194. Once released, the tag detacher 190 becomes operational or is enabled as described above (if disabled while locked in the nest). The tag detacher 190 is disabled upon (a) the detachment of all security tags coupled to successfully purchased items, and/or (b) the expiration of a defined period of time (e.g., 15 minutes from the tag detacher's release from the cradle or 10 minutes since the last security tag's detachment). The present solution is not limited to the particulars of this scenario.

In other scenarios, the enterprise system (e.g., EAS system 130, monitoring system 134, public network 106, and/or RTS 118 of FIG. 1) detects when a customer 140 enters the RSF 150. Upon such detection, the enterprise system communicates with the customer's MCD 104. As a result of the communications, the enterprise system provides the customer's MCD 104 with a code for the tag detacher 190. In turn, the customer's MCD 104 provides the code to the cradle 194. Upon receipt of the code, the cradle 194 performs operations to compare the entered code to at least one reference code generated by or stored in a memory of the cradle 194 (e.g., memory 1512 of FIG. 15). If a match exists, then the tag detacher 190 is released from the cradle 194. Once released, the tag detacher 190 can be enabled as described above (if disabled when in the nest). The tag detacher 190 is disabled upon (a) the detachment of all security tags coupled to successfully purchased items, and/or (b) the expiration of a defined period of time (e.g., 15 minutes from the tag detacher's release from the cradle or 10 minutes since the last security tag's detachment). The present solution is not limited to the particulars of this scenario.

Figure 15:
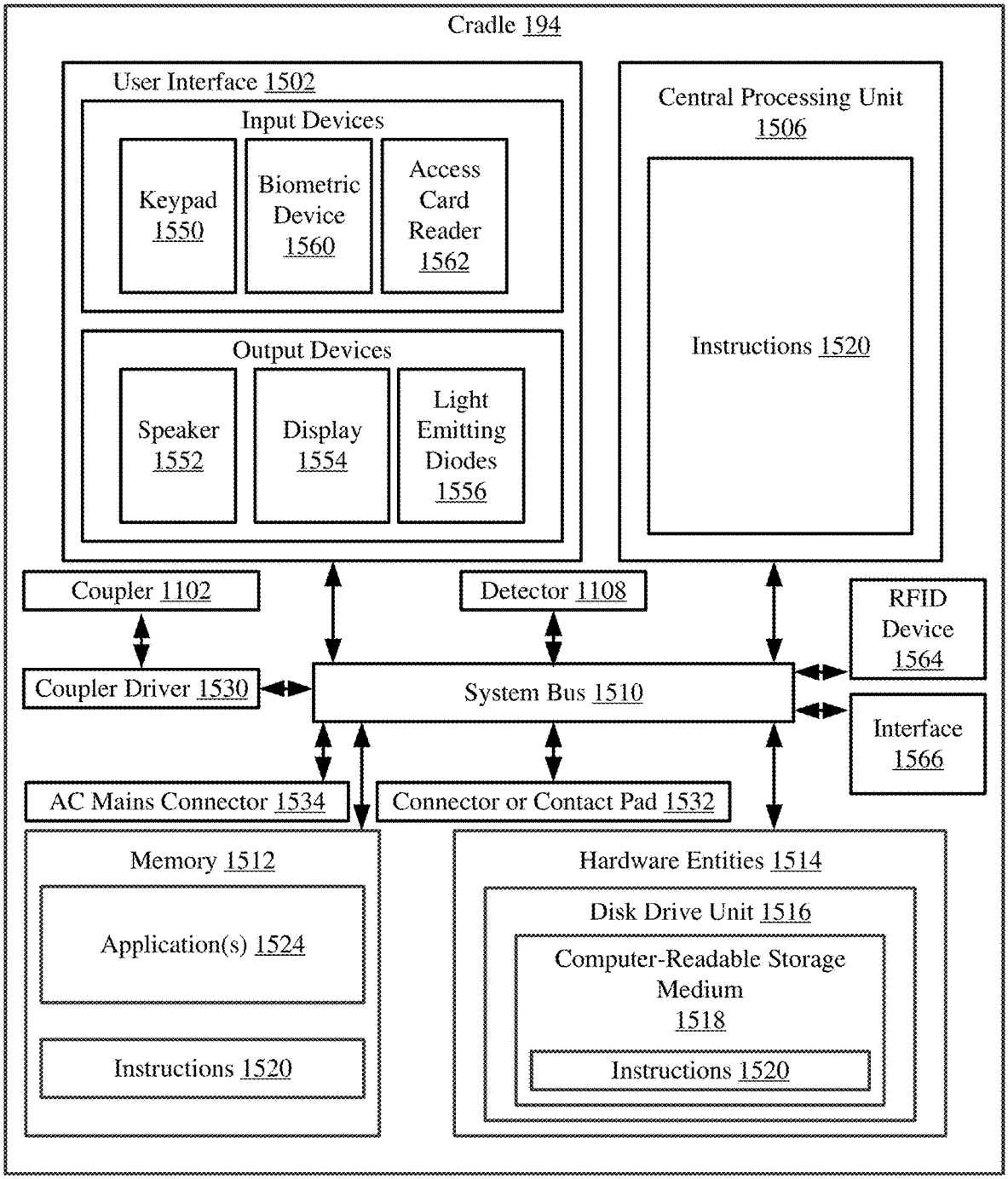
FIG. 15 is a block diagram of an illustrative architecture for the cradle.

An illustration of the cradle's internal circuitry is provided in FIG. 15. Cradle 194 can include more or less components than those shown in FIG. 15. However, the components shown are sufficient to disclose an illustrative embodiment implementing the present solution. The hardware architecture of FIG. 15 represents one embodiment of a representative cradle configured to facilitate (a) the conversion of a tag detacher from a portable state (shown in FIG. 12) into a fixed state (shown in FIG. 9) and (b) the conversion of the tag detacher from the fixed state back into the portable state. As such, the cradle 194 of FIG. 15 implements at least a portion of the methods described herein.

Some or all the components of the cradle 194 can be implemented as hardware, software and/or a combination of hardware and software. The hardware includes, but is not limited to, one or more electronic circuits. The electronic circuits can include, but are not limited to, passive components (e.g., resistors and capacitors) and/or active components (e.g., amplifiers and/or microprocessors). The passive and/or active components can be adapted to, arranged to and/or programmed to perform one or more of the methodologies, procedures, or functions described herein.

As shown in FIG. 15, the cradle 194 comprises a user interface 1502, a Central Processing Unit ("CPU") 1506, a system bus 1510, a memory 1512 connected to and accessible by other portions of cradle 194 through system bus 1510, and hardware entities 1514 connected to system bus 1510. The user interface can include input devices (e.g., a keypad 1550, a biometric device 1560, and/or an access card reader 1562) and output devices (e.g., speaker 1552, a display 1554, and/or light emitting diodes 1556), which facilitate user-software interactions for controlling operations of the cradle 194.

At least some of the hardware entities 1514 perform actions involving access to and use of memory 1512, which can be a RAM, a disk driver and/or a Compact Disc Read Only Memory ("CD-ROM"). Hardware entities 1514 can include a disk drive unit 1516 comprising a computer-readable storage medium 1518 on which is stored one or more sets of instructions 1520 (e.g., software code) configured to implement one or more of the methodologies, procedures, or functions described herein. The instructions 1520 can also reside, completely or at least partially, within the memory 1512 and/or within the CPU 1506 during execution thereof by the cradle 194. The memory 1512 and the CPU 1506 also can constitute machine-readable media. The term "machine-readable media", as used here, refers to a single medium or multiple media (e.g., a centralized or distributed database, and/or associated caches and servers) that store the one or more sets of instructions 1520. The term "machine-readable media", as used here, also refers to any medium that is capable of storing, encoding or carrying a set of instructions 1520 for execution by the cradle 194 and that cause the cradle 194 to perform any one or more of the methodologies of the present disclosure.

In some scenarios, the hardware entities 1514 include an electronic circuit (e.g., a processor) programmed for facilitating (a) the actuation of couplers 1102 for attaching the tag detacher to the cradle when a detector 1108 (e.g., a push button located at the bottom of the nest) detects the tag detacher 190 is properly placed in the nest 1104, (b) the authentication of an individual 140, 142 using the tag detacher 190, (c) the actuation of couplers 1102 for releasing the tag detacher from the cradle when the identity of the individual has been authenticated or a code has been received, and (d) the recharging of a power source internal to the tag detacher 190 and/or MCD 104. The authentication can be achieved using the biometric device 1560 (e.g., a fingerprint scanner), an access card reader 1562, and/or an RFID device 1564. Each of the listed devices are well known in the art, and therefore will not be described herein. Any known or to be known biometric device, access card reader and/or RFID device can be used herein without limitation.

In this regard, it should be understood that the electronic circuit can access and run one or more applications 1524 installed on the cradle 194. The software application 1524 is generally operative to facilitate: the determination of a tag detacher's presence in the nest; an authentication of an individual's identity; reception of a code; power supply to the tag detacher 190 via connector or control pad(s) 1532; the selective actuation of couplers 1102 via control of a coupler driver 1530 (e.g., a motor, a gear, a solenoid, and/or magnets); and/or the provision of auditory, visual or tactile alerts and/or notifications to the user. Other functions of the software application 1524 will become apparent as the discussion progresses.

Figure 12:
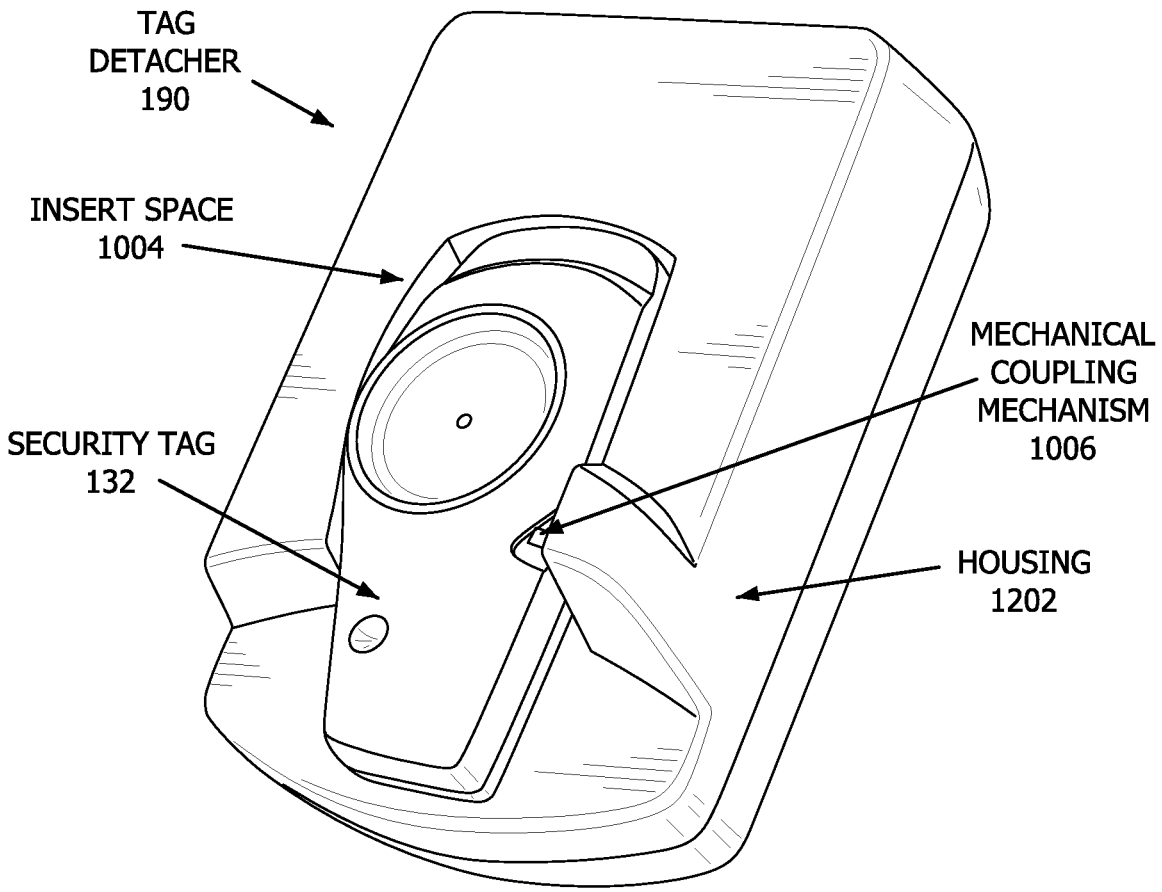
FIG. 12 is an illustration showing a security tag disposed in an insert space of the tag detacher.

Referring now to FIGS. 9, 10, 12-13 and 16, the tag detacher 190 will be discussed in more detail. The tag detacher 190 comprises an insert space 1004 sized and shaped to receive the security tag 132. An illustration of the security tag 132 inserted into the insert space 1004 is shown in FIG. 12. The security tag 132 is positioned in insert space 1004 such that the tack assembly 204 or the opening 206 is accessible to the user.

The security tag 132 is secured in the insert space 1004 via a mechanical coupling mechanism 1006. In this regard, the mechanical coupling mechanism 1006 selectively prevents the tag body 202 from being removed from the tag detacher 190 and selectively allows the tag body 202 to be removed from the tag detacher 190. Mechanical coupling mechanisms are well known in the art, and therefore will not be described in detail herein. Any known or to be known mechanical coupling mechanism can be used herein without limitation. For example, in some scenarios, the mechanical coupling mechanism 1006 comprises a mechanical latch. The mechanical latch includes a retractable hook or bar. FIG. 10 shows the retractable hook or bar in an unengaged position in which it is fully retracted into the tag detacher's housing 1202. FIG. 12 shows the retractable hook or bar in an engaged position in which it at least partially projects out of the tag detacher's housing 1202 and into the insert space 1004. In the engaged position, the retractable hook or bar provides an obstruction that prevents the removal of the tag body 202 from the insert space 1004.

In some scenarios, the tag detacher 190 comprises a proximity switch 1008 that detects when the security tag 132 is loaded into the insert space 1004. When such a detection is made, an internal servo motor 1636 is engaged. The servo motor 1636 moves the retractable hook or bar from its unengaged position to its engaged position for preventing the tag body 202 from being removed from the insert space 1004. The retractable hook or bar remains in its engaged position until a trigger event occurs, such as the expiration of a predefined period of time or the completion of tag detaching operations. In response to the detection of a trigger event, the servo motor 1636 is operated to retract the retractable hook or bar, i.e., transition the retractable hook or bar from its engaged position to its unengaged position.

Once the security tag 132 is latching coupled to the tag detacher 190, the detachment prevention mechanism 824 is actuated, for example, by applying a magnetic field thereto via magnet. The magnet can be moved into proximity of the detachment prevention mechanism 824 using a motor 1632. Such actuation causes the detachment prevention mechanism 824 to be transitioned from its engaged position (in which it extends into the arcuate channel 502 and/or engages the securement mechanism 406 to prevent rotation thereby) to its unengaged position (in which it no longer extends into the channel 502 and/or engages the securement mechanism 406 such that the securement mechanism 406 can be rotated about circular mount 602 when a pushing force is applied thereto by the detachment mechanism 302).

Next, a driver 1634 is engaged. The driver 1634 includes, but is not limited to, a servo motor, gears, and/or a mechanical linkage (e.g., with joints). The driver 1634 moves the detachment mechanism 302 from its unengaged position (in which it fully resides in the tag detacher 190) to its engaged position (in which it engages the securement mechanism 406 as shown in FIG. 6) for causing the securement mechanism 406 of the security tag 132 to release the tack assembly 204, as described above.

Figure 16:
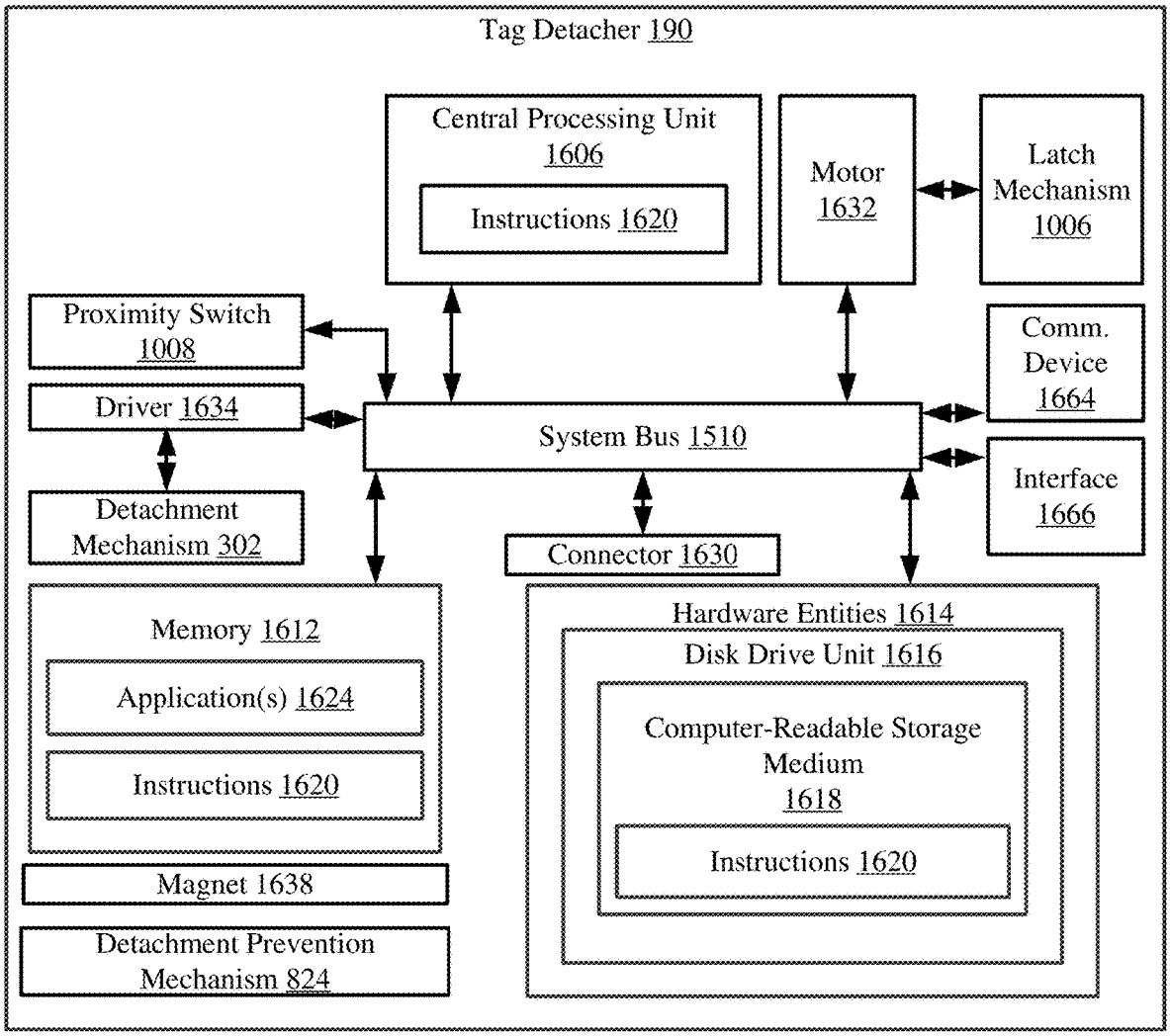
FIG. 16 is a block diagram of an illustrative architecture for the tag detacher.

As shown in FIG. 16, the tag detacher 190 comprises internal circuitry. Tag detacher 190 can include more or less components than those shown in FIG. 16. However, the components shown are sufficient to disclose an illustrative embodiment implementing the present solution. The hardware architecture of FIG. 16 represents one embodiment of a representative tag detacher configured to facilitate (a) the attachment of security tags to articles and/or (b) the detachment of security tags from articles. As such, the tag detacher 190 of FIG. 16 implements at least a portion of the methods described herein.

Some or all the components of the tag detacher 190 can be implemented as hardware, software and/or a combination of hardware and software. The hardware includes, but is not limited to, one or more electronic circuits. The electronic circuits can include, but are not limited to, passive components (e.g., resistors and capacitors) and/or active components (e.g., amplifiers and/or microprocessors). The passive and/or active components can be adapted to, arranged to and/or programmed to perform one or more of the methodologies, procedures, or functions described herein.

As shown in FIG. 16, the tag detacher 190 comprises a CPU 1606, a system bus 1610, a memory 1612 connected to and accessible by other portions of tag detacher 190 through system bus 1610, and hardware entities 1614 connected to system bus 1610. At least some of the hardware entities 1614 perform actions involving access to and use of memory 1612, which can be a RAM, a disk driver and/or a Compact Disc Read Only Memory ("CD-ROM"). Hardware entities 1614 can include a disk drive unit 1616 comprising a computer-readable storage medium 1618 on which is stored one or more sets of instructions 1620 (e.g., software code) configured to implement one or more of the methodologies, procedures, or functions described herein. The instructions 1620 can also reside, completely or at least partially, within the memory 1612 and/or within the CPU 1606 during execution thereof by the tag detacher 190. The memory 1612 and the CPU 1606 also can constitute machine-readable media. The term "machine-readable media", as used here, refers to a single medium or multiple media (e.g., a centralized or distributed database, and/or associated caches and servers) that store the one or more sets of instructions 1620. The term "machine-readable media", as used here, also refers to any medium that is capable of storing, encoding or carrying a set of instructions 1620 for execution by the tag detacher 190 and that cause the tag detacher 190 to perform any one or more of the methodologies of the present disclosure.

The hardware entities 1614 include an electronic circuit (e.g., a processor) programmed for facilitating (a) the actuation of latch mechanism 1006, (b) the actuation of detachment prevention mechanism 824, and/or (c) the actuation of detachment mechanism 302. In this regard, it should be understood that the electronic circuit can access and run one or more applications 1624 installed on the tag detacher 190. The software application 1624 is generally operative to facilitate: the determination of a security tag's presence in the insert space 1004; an authentication of an individual's identity; reception of a code; the supply of power to the MCD 104; and/or the selective control of motor 1632 and driver 1634. Other functions of the software application 1624 will become apparent from the discussion provided above and below.

Notably, the tag detacher 190 does not include a user interface in the scenario shown in FIG. 16. Accordingly, the tag detacher 190 is configured to be integrated with the MCD 104. In this regard, the tag detacher 190 comprises an insert space 1302 sized and shaped for receiving the MCD 104. When inserted into the insert space 1302, the MCD 104 is electrically and mechanically coupled to the tag detacher 190 via mating connectors (e.g., Universal Serial Bus ("USB") connectors 1630) thereof. An illustration of the MCD 104 being inserted into insert space 1302 is provided in FIG. 13. An illustration of the MCD 104 fully inserted into insert space 1302 is provided in FIG. 14.

Figure 13:
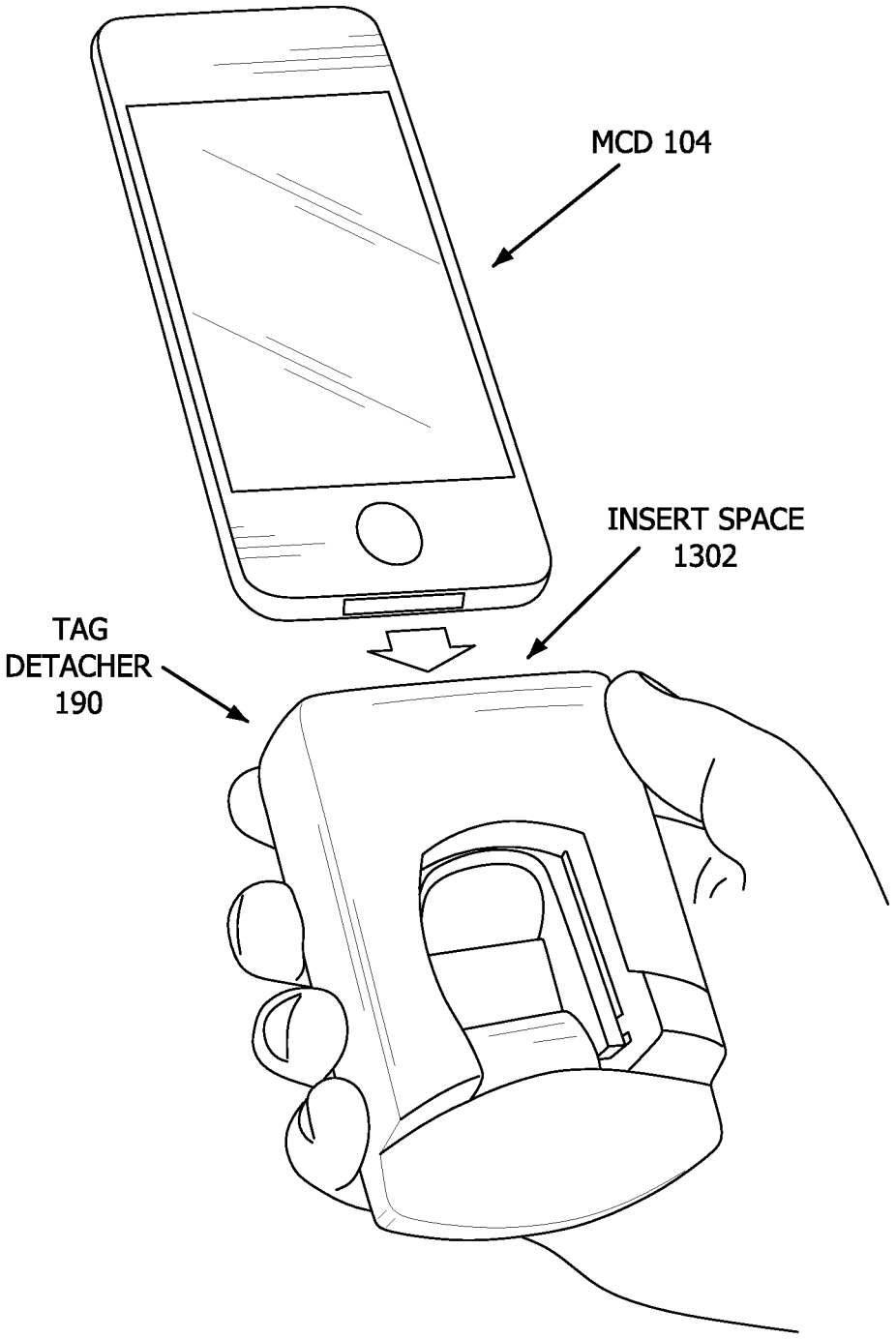
FIG. 13 is an illustration of a mobile device being inserted into the tag detacher.
Figure 14:
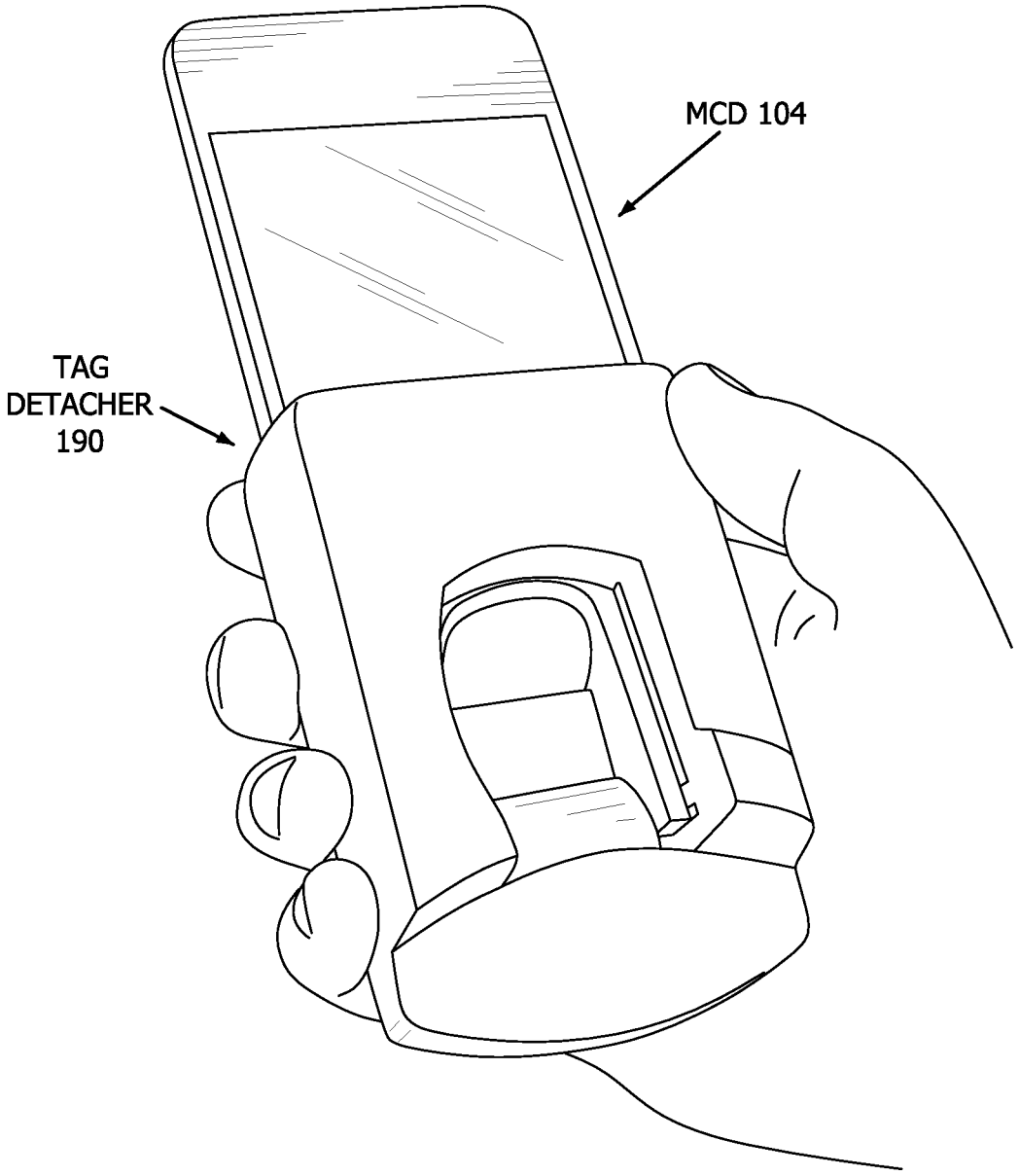
FIG. 14 is an illustration of the mobile device of FIG. 13 inserted into the tag detacher.

The device integration allows the user interface of the MCD 104 to be used to facilitate user-software interactions for controlling operations of the tag detacher 190. MCD's are well known in the art, and therefore will not be described in detail herein. Any known or to be known MCD can be used herein without limitation. For example, in some scenarios, the MCD 104 comprises a smart phone as shown in FIGS. 13-14. As known in the art, the user interface of a smart phone includes input devices (e.g., a keypad, a biometric device, and/or an access card reader) and output devices (e.g., a speaker, a display, and/or light emitting diodes).

Referring now to FIG. 17, there is provided a flow diagram of an illustrative method 1700 for detaching a security tag (e.g., security tag 132 of FIG. 1) from an article (e.g., article 102 of FIG. 1). Method 1700 comprises a plurality of operations 1702-1782. The present solution is not limited to the order in which these operations are shown in FIG. 17. The order of the operations 1702-1782 can be modified for any given application.

Figure 17A:
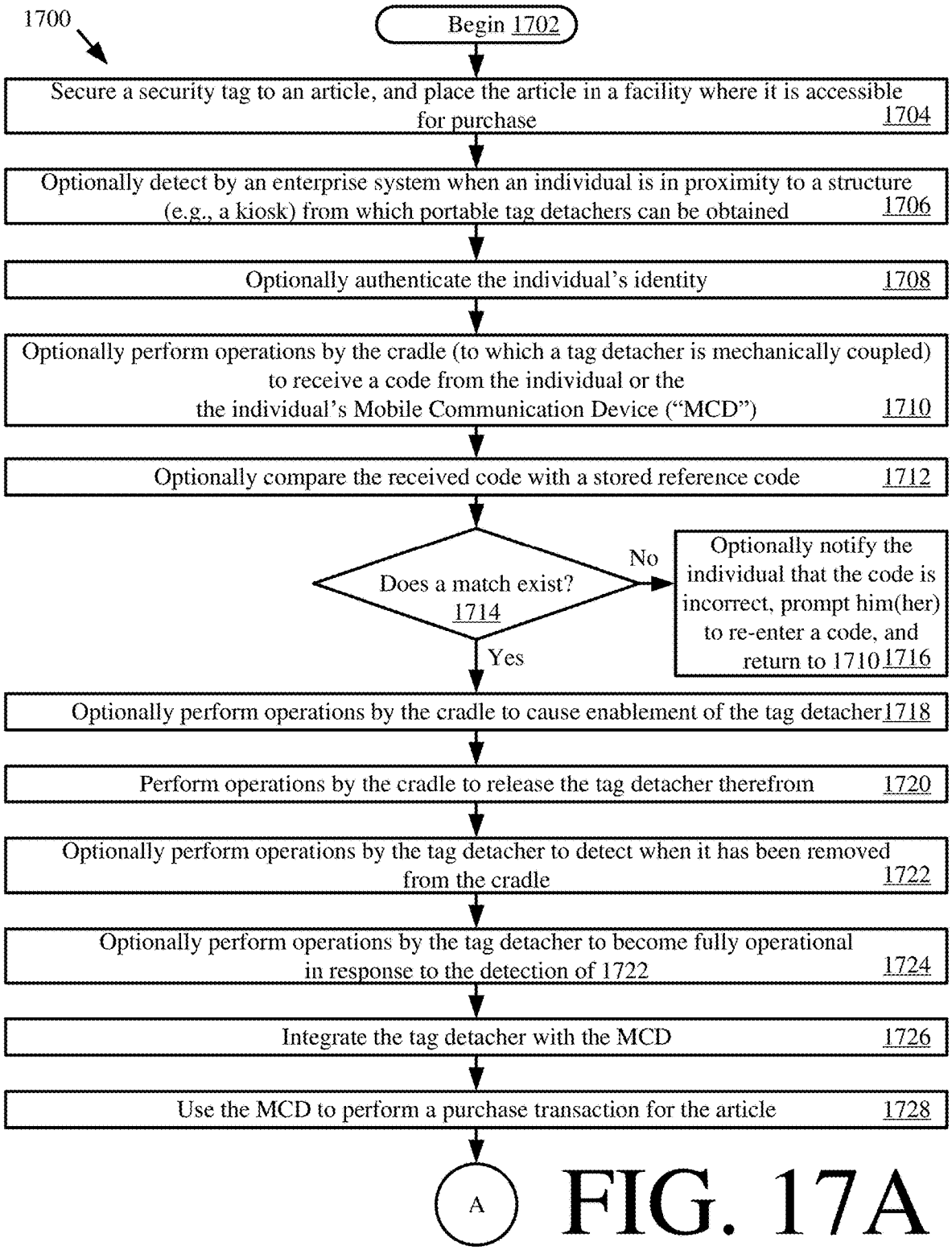
Figure 17D:
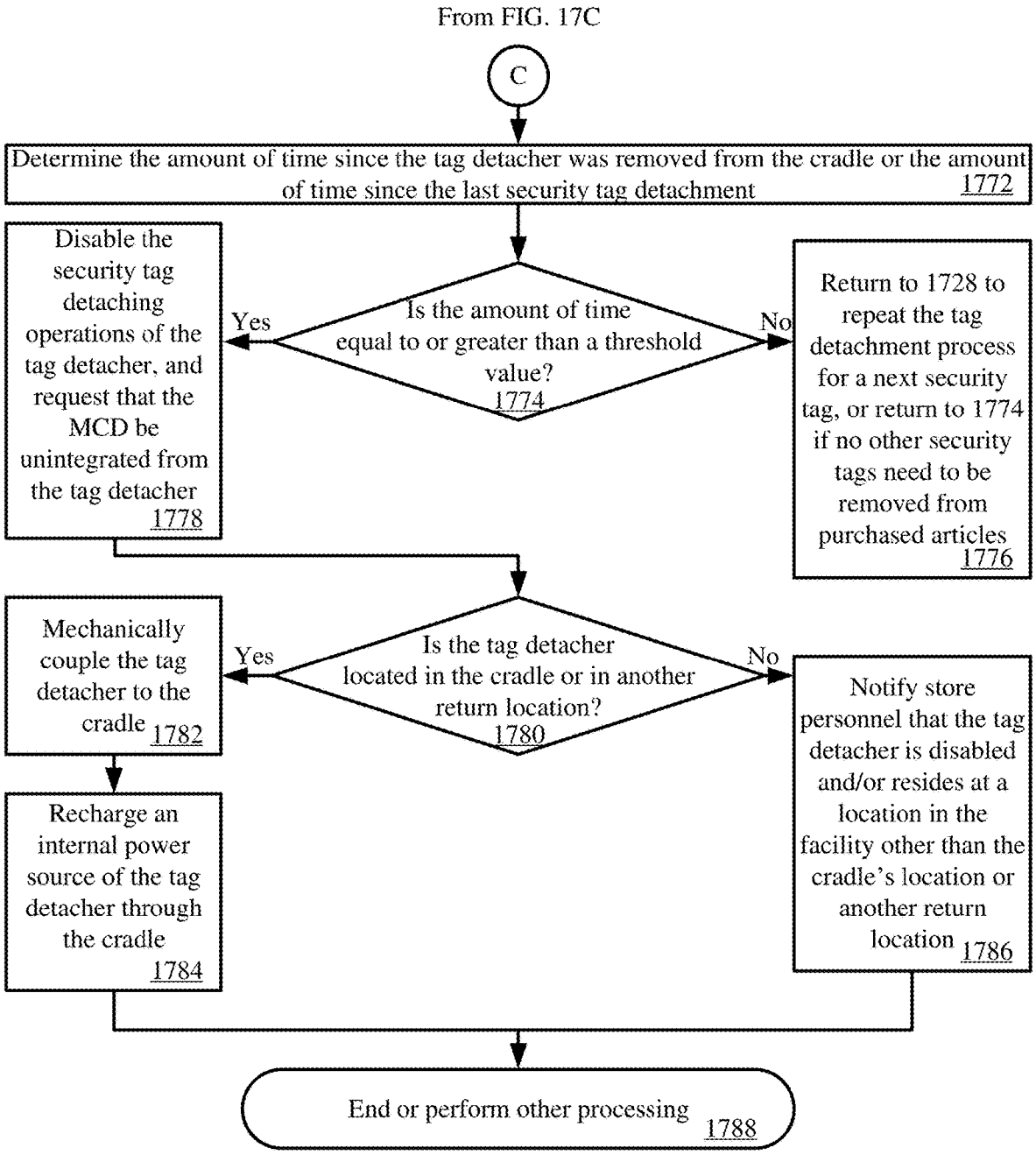

As shown in FIG. 17A, method 1700 begins with 1702 and continues with 1704 where the security tag is secured to the article. The article is then placed in a facility (e.g., RSF 150 of FIG. 1) where it is accessible for purchase. Thereafter, method 1700 continues with optional blocks 1706-1718 for selectively releasing a tag detacher (e.g., tag detacher 190 of FIG. 1) from a cradle (e.g., cradle 194 of FIG. 1) based in certain criteria.

Block 1706 involves detecting by an enterprise system when an individual is in proximity to a structure (e.g., a kiosk) for which portable tag detachers can be obtained. This detection can be made via a proximity sensor (e.g., a beam break sensor) disposed on or adjacent to the structure. Next operations are performed in 1708 by the enterprise system to authenticate the individual's identity. Such authentication techniques are well known in the art, and therefore will not be described in detail herein. Any known or to be known authentication technique can be used herein without limitation. For example, in some scenarios, the authentication is achieved by: retrieving an identifier from the individual's MCD (e.g., MCD 104 of FIG. 1); comparing the retrieved identifier to reference information stored in a remote database; and making a determination that the individual is the person associated with the reference information matching the retrieved identifier.

Blocks 1710-1714 involve: performing operations by the cradle (to which the tag detacher is mechanically coupled) to receive a code from the individual or the individual's MCD;

comparing the received code with at least one stored reference code; and determining if a match exists therebetween. If the received code does not match the reference code [1714: NO], then 1716 is performed where the individual is notified that the inputted code is incorrect. The individual may also be prompted to re-enter a code. The notification and prompt can be performed by the cradle, the kiosk, or the individual's MCD. Subsequently, method 1700 returns to 1710. If the received code does match the reference code [1714: YES], then the cradle performs operations in 1718 to cause enablement of the tag detacher.

Upon completing 1706, 1708, 1714 or 1718, 1720 is performed where the cradle performs operations to release the tag detacher therefrom. The tag detacher can be released by retracting couplers (e.g., couplers 1102 of FIG. 11) of the cradle from apertures (e.g., apertures 1002 of FIG. 10) of the tag detacher. Once released, the individual removes the tag detacher from the cradle.

In some scenarios, the cradle does not enable the tag detacher in 1718. In this case, the tag detacher: detects when it has been removed from the cradle as shown by optional block 1722; and performs operations to become fully operational in response to this detection as shown by block 1724. In some scenarios, this detection is made when a push button of the tag detacher is no longer being depressed or a signal is no longer being received from the cradle. The present solution is not limited in this regard.

In 1726, the tag detacher is integrated with the individual's MCD. This integration can be achieved by: establishing a communications connection between the tag detacher and the individual's MCD; or mechanically and electrically coupling the MCD to the tag detacher (e.g., as shown in FIG. 14). As a result of this integration, the MCD provides a means for controlling operations of the tag detacher.

Next in 1728, the MCD is used to perform a purchase transaction for the article. Techniques for performing purchase transactions using an MCD are well known in the art, and therefore will not be described herein. Any known or to be known technique for performing purchase transactions using an MCD can be used herein without limitation. After completing 1728, method 1700 continues with 1730 of FIG. 17B. In 1730, a determination is made as to whether a successful purchase transaction has been performed. If not [1730: NO], then method 1700 returns to 1730. If so [1730: YES], then method continues with 1732. 1732 involves starting a security tag detaching process automatically by the MCD, an RTS (e.g., RTS 118 of FIG. 1), or in response to a user-software interaction with the MCD or RTS.

Next in optional blocks 1734-1738, operations are performed by the MCD to: prompt the individual to place the security tag and/or article in proximity thereto so that at least one barcode can be read; read a barcode of the security tag and/or article to which the security tag is coupled; and verify that the article is the article which was successfully purchased or the security tag is coupled to such an article. If the article's purchase or the tag's identity was not verified [1740: NO], then the individual is notified that the article is not one that was successfully purchased. Method 1700 then returns to 1734. If the article's purchase or the tag's identity was verified [1740: YES], then method 1700 continues with 1744 which will be described below.

In 1744, the MCD performs operations to instruct the individual to place the security tag in the tag detacher so that it can be removed from the purchased article. Thereafter in 1746, the tag detacher receives the security tag in an insert space (e.g., insert space 1004 of FIG. 10). Next, operations of optional blocks 1748-1754 in FIG. 7C are performed.

As shown in FIG. 7C, optional blocks 1748-1750 involve: performing SRC operations (e.g., RFID communications) by the tag detacher to obtain information from the security tag (e.g., an article or tag identifier); and comparing the received information to reference information to determine if a match exists therebetween. If a match does not exist [1752: NO], then the individual is notified via the MCD that the article is not one that was successfully purchased. Method 1700 returns to 1728. In contrast, if a match does exist [1752: YES], then method 1700 continues with 1756 which is described below.

In block 1756, the tag detacher performs operations to mechanically couple the security tag thereto. The mechanical coupling can be achieved by actuating a mechanical coupling mechanism (e.g., mechanical coupling mechanism 1006 of FIG. 10) for transitioning it to an engaged position in which the tag body (e.g., tag body 202 of FIG. 2) is prevented from being removed from the tag detacher.

As noted above, the security tag may comprise a detachment prevention mechanism (e.g., detachment prevention mechanism 824 of FIG. 8). In this scenario, 1758 is performed to actuate the detachment prevention mechanism so as to transition the same from an engaged position to an unengaged position. The actuation can be achieved by moving a magnet (e.g., magnet 1638 of FIG. 16) of the tag detacher into proximity of the detachment prevention mechanism.

Upon completing 1756 or 1758, 1760 is performed where a detachment mechanism (e.g., detachment mechanism 302 of FIG. 3) of the tag detacher is actuated. As a result of this actuation, a tack assembly (e.g., tack assembly 204 of FIG. 2) is released from a securement mechanism (e.g., securement mechanism 406 of FIG. 4) of the security tag. The tag detacher then performs operations to (a) wait a given amount of time or (b) detect when the tack assembly has been removed from the security tag's body. In some scenarios, the detection of (b) is achieved: in accordance with a technique disclosed in U.S. Pat. No. 9,390,602 to Patterson et al.; or through a user-software interaction with the MCD integrated with the tag detacher. The present solution is not limited in this regard. Other known or to be known techniques for making the detection of (b) can be used herein. The security tag's body is released in 1764 from the tag detacher when the given amount of time expires or the detection of (b) is made. At this time, the individual can remove the tag body from the tag detacher, and place it in a tag return receptacle located within the facility.

Throughout the use of the tag detacher, the enterprise system (e.g., RTS 118 of FIG. 1) performs operations to track the location of the tag detacher within the facility, as shown by 1766. If the tag detacher is being removed from the facility [1768: YES], then the tag detacher is disabled as shown by 1770. The individual may also be notified via the MCD that the tag detacher needs to be returned to the cradle. Store personnel may further be notified via the enterprise system of the tag detacher's removal from the facility by the individual. Method 1700 then goes to 1788 of FIG. 17D where the method ends or other processing is performed.

If the tag detacher is not being removed from the facility [1768: NO], then method 1700 continues with 1772 of FIG. 17D. 1772 involves determining an amount of time since the tag detacher was removed from the cradle or the amount of time since the last security tag detachment. If the amount of time is less than a threshold value [1774: NO], then 1776 is performed where method 1700 returns to 1728 to repeat the tag detachment process for a next security tag or returns to 1774 if no other security tags need to be removed from purchased articles.

If the amount of time is equal to or greater than the threshold value [1774: YES], then 1778 is performed wherein at least the security tag detaching operations are disabled and/or a request is made to the individual that the MCD be unintegrated from the tag detacher. In response to the request, the user performs actions to (a) terminate the pairing between the MCD and tag detacher or (b) remove the MCD from the insert space (e.g., insert space 1302 of FIG. 13) of the tag detacher.

In 1780, a decision is made as to whether the tag detacher is located in the cradle or in another return location within the facility. If so [1780: YES], then 1782-1784 are performed. 1782-1784 involve: mechanically coupling the tag detacher to cradle; and recharging an internal power source (e.g., battery 820 of FIG. 8) of the security tag through the cradle. If not [1780: NO], 1786 is performed where store personnel is notified that the tag detacher is disabled and resides at a location in the facility other than the cradle's location or another return location. Subsequently, the method 1700 ends or other processing is performed as shown by 1788.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. A method for detaching a security tag from an article, comprising:

integrating a mobile communication device with a mobile tag detacher by receiving at least a portion of the mobile communication device in a first insert space of the mobile tag detacher whereby the portion of the mobile communication device is housed inside the mobile tag detacher, and mechanically and electrically coupling the mobile communication device to the mobile tag detacher;

receiving a tag body of the security tag in a second insert space of the mobile tag detacher;

mechanically coupling the tag body of the security tag to the mobile tag detacher if at least one of the mobile communication device and the mobile tag detacher verified that removal of the security tag from the article is permitted;

performing operations by the mobile tag detacher to facilitate the detachment of the security tag from the article; and decoupling the tag body from the mobile tag detacher such that the tag body is removable from the second insert space.

2. The method according to claim 1, wherein the mobile tag detacher is being worn by an individual.

3. The method according to claim 1, further comprising releasing the mobile tag detacher from a cradle prior to said integrating.

4. The method according to claim 3, wherein the mobile tag detacher is released from the cradle when a given code is received at the cradle or a user of the mobile communication device has been authenticated.

5. The method according to claim 3, further comprising performing operations by the cradle to cause the mobile tag detacher to become fully operational prior to releasing the mobile tag detacher from the cradle.

6. The method according to claim 3, further comprising performing operations by the mobile tag detacher to become fully operational when a detection is made by the mobile tag detacher that the mobile tag detacher has been removed from the cradle.

7. The method according to claim 3, wherein an internal power source of the mobile tag detacher is charged through the cradle while the mobile tag detacher resides in a nest of the cradle.

8. The method according to claim 1, wherein barcode technology of the mobile communication device or wireless communication technology of the mobile tag detacher is used to verify that removal of the security tag from the article is permitted.

9. The method according to claim 1, further comprising performing operations by the mobile communication device to facilitate a purchase transaction for the article, and to output instructions for inserting the security tag in the mobile tag detacher after completion of the purchase transaction.

10. The method according to claim 1, further comprising:

tracking the security tag's location within a facility; and disabling the mobile tag detacher if the mobile tag detacher is being removed from the facility.

11. The method according to claim 1, further comprising determining a first amount of time since the mobile tag detacher was removed from a cradle or a second amount of time since a last security tag detachment.

12. The method according to claim 11, further comprising determining if the first or second amount of time is equal to or greater than a threshold value.

13. The method according to claim 12, further comprising disabling the mobile tag detacher if the first or second amount of time is equal to or greater than the threshold value.

14. The method according to claim 1, further comprising:

tracking the mobile tag detacher's location within a facility;

determining whether the mobile tag detacher is located in a cradle or given return location within the facility; and notifying personnel of a determination that the mobile tag detacher is not located in the cradle or the given return location when the mobile tag detacher is no longer being utilized for tag detachment purposes by a given individual.

15. A system, comprising:

a mobile tag detacher configured to:

integrate with a mobile communication device by receiving at least a portion of the mobile communication device in a first insert space whereby the portion of the mobile communication device is housed inside the mobile tag detacher, and establishing a mechanical and electrical coupling to the mobile communication device;

receive a tag body of a security tag in a second insert space;

mechanically couple the tag body of the security tag to the mobile tag detacher if at least one of the mobile communication device and the mobile tag detacher verified that removal of the security tag from the article is permitted;

facilitate a detachment of the security tag from the article; and decouple the tag body from the mobile tag detacher such that the tag body is removable from the second insert space.

16. The system according to claim 15, wherein the mobile tag detacher is being worn by an individual.

17. The system according to claim 15, further comprising a cradle sized and shaped to receive the mobile tag detacher.

18. The system according to claim 17, wherein the cradle is configured to release the mobile tag detacher therefrom when a given code is received at the cradle or a user of the mobile communication device has been authenticated.

19. The system according to claim 17, wherein the cradle is configured to cause the mobile tag detacher to become fully operational prior to being released from the cradle.

20. The system according to claim 17, wherein the mobile tag detacher is further configured to become fully operational when a detection is made thereby that the mobile tag detacher has been removed from the cradle.

21. The system according to claim 17, wherein an internal power source of the mobile tag detacher is charged through the cradle while the mobile tag detacher resides in a nest of the cradle.

22. The system according to claim 15, wherein barcode technology of the mobile communication device or wireless communication technology of the mobile tag detacher is used to verify that removal of the security tag from the article is permitted.

23. The system according to claim 15, wherein the mobile communication device facilitates a purchase transaction for the article, and outputs instructions for inserting the security tag in the mobile tag detacher after completion of the purchase transaction.

24. The system according to claim 15, wherein the mobile tag detacher is disabled if the mobile tag detacher is being removed from the facility.

25. The system according to claim 15, wherein the mobile tag detacher is further configured to determine a first amount of time since the mobile tag detacher was removed from a cradle or a second amount of time since a last security tag detachment.

26. The system according to claim 25, wherein the mobile tag detacher is further configured to determine if the first or second amount of time is equal to or greater than a threshold value.

27. The system according to claim 26, wherein the mobile tag detacher is disabled if the first or second amount of time is equal to or greater than the threshold value.

28. The system according to claim 15, further comprising an enterprise device configured to:

track the mobile tag detacher's location within a facility;

determine whether the mobile tag detacher is located in a cradle or given return location within the facility; and notify personnel of a determination that the mobile tag detacher is not located in the cradle or the given return location when the mobile tag detacher is no longer being utilized for tag detachment purposes by a given individual.

* * * * *